US005310611A

United States Patent [19]

Okabe et al.

[11] Patent Number: 5,310,611

[45] Date of Patent: May 10, 1994

[54] THERMOREVERSIBLE RECORDING MATERIAL, THERMOREVERSIBLE RECORDING MEDIUM AND RECORDING METHOD

[75] Inventors: Yutaka Okabe; Yoichi Nishioka; Yukihisa Okada, all of Tokyo, Japan

[73] Assignee: Oki Electric Industry Co., Ltd., Tokyo, Japan

[21] Appl. No.: 953,785

[22] Filed: Sep. 30, 1992

[30] Foreign Application Priority Data

| | | | |
|---|---|---|---|
| Oct. 4, 1991 | [JP] | Japan | 257626 |
| Jun. 3, 1992 | [JP] | Japan | 142350 |
| Aug. 21, 1992 | [JP] | Japan | 222324 |
| Sep. 21, 1992 | [JP] | Japan | 251174 |

[51] Int. Cl.[5] ..... B41M 5/26

[52] U.S. Cl. ..... 430/19; 430/495; 430/945; 346/135.1; 503/214

[58] Field of Search ..... 430/19, 495, 945; 346/135.1; 503/214

[56] References Cited

U.S. PATENT DOCUMENTS

| | | | |
|---|---|---|---|
| 3,293,055 | 12/1966 | Baum | 106/171 |
| 3,451,338 | 6/1969 | Baum | 427/148 |
| 3,539,375 | 11/1970 | Baum | 503/214 |
| 4,695,528 | 9/1987 | Dabisch et al. | 430/290 |
| 4,734,359 | 3/1988 | Oguchi et al. | 430/945 |
| 4,777,492 | 10/1988 | Ohnishi et al. | 346/1.1 |
| 4,965,591 | 10/1990 | Kurabayashi et al. | 346/108 |
| 5,085,934 | 2/1992 | Hotta et al. | 428/335 |
| 5,087,601 | 2/1992 | Hotta et al. | 503/200 |
| 5,108,980 | 4/1992 | Hotta et al. | 503/226 |
| 5,116,803 | 5/1992 | Hotta et al. | 503/208 |
| 5,157,011 | 10/1992 | Okabe et al. | 503/201 |

FOREIGN PATENT DOCUMENTS

| | | |
|---|---|---|
| 302374A2 | 2/1989 | European Pat. Off. . |
| 429010A2 | 5/1991 | European Pat. Off. . |
| 4019683 | 1/1991 | Fed. Rep. of Germany . |
| 45-14039 | 5/1970 | Japan . |
| 54-119377 | 9/1979 | Japan . |
| 55-154198 | 12/1980 | Japan . |

*Primary Examiner*—Charles L. Bowers, Jr.
*Assistant Examiner*—John A. McPherson
*Attorney, Agent, or Firm*—Spencer, Frank & Schneider

[57] ABSTRACT

A thermoreversible recording material having its transparency changed in accordance with its thermal history, in particular the rate of cooling and the temperature to which it has been heated, comprises a matrix material and an organic compound of low molecular weight, wherein the matrix material comprises polyvinyl acetal, and the organic compound of low molecular weight comprises a saturated carboxylic acid or derivative thereof. The matrix material may further contains a material selected from a group consisting of epoxy resin, phenol resin, epoxy compound, aldehyde compound and isocyanate compound. A thermoreversible recording medium comprising the above thermoreversible recording material may be selectively heated by a thermal head or the like to record visual information. The visual information may be erased by heating the medium and cooling it slowly.

49 Claims, 14 Drawing Sheets

THERMOREVERSIBLE RECORDING MATERIAL, THERMOREVERSIBLE RECORDING MEDIUM AND RECORDING METHOD

BACKGROUND OF THE INVENTION

This invention relates to: thermoreversible recording materials which permits repeated reversible recording and erasure of visual information by the use of a heating means; to thermoreversible recording media using those thermoreversible recording materials; and to recording methods using those thermoreversible recording media.

A thermoreversible recording material has a property that its degree of transparency or transmittance at least with respect to visible light, varies in accordance with its thermal history. It is therefore possible, through the application of, for example, a thermal head or other heating means to such a thermoreversible recording material, to create a difference in the thermal history between a specific portion of the material and another portion, thereby creating a difference in the transmittance between the two portions for purposes of display or recording.

Thermoreversible recording materials according to the prior art are disclosed, for example, in Japanese Patent Kokai Publication No. S55-154198.

The thermoreversible recording materials disclosed in this publication are made of a matrix material of polymers, such as polyester, or resins, in which are dispersed organic compounds of low molecular weight, such as behenic acid.

FIG. 27 shows a hysteresis curve illustrating the variation of the light transmittance of a prior-art thermoreversible recording material against temperature, with transmittance on the vertical axis and temperature on the horizontal. Following is a description of the properties of thermoreversible recording materials according to the prior art with reference to FIG. 27. Points (A), (B), (C) and (D) in FIG. 27 show values of transmittance at respective temperatures. Specifically, (A) and (D) denote transmittances at room temperature (RT), (B) denotes transmittance at temperature T1, and (C) denotes transmittance at temperature T2.

In the vicinity of room temperature (RT), thermoreversible recording materials according to the prior art exhibit either low transmittance (A) (an opaque state) or high transmittance (D) (a transparent state) in FIG. 27, depending on the thermal history. If such a thermoreversible recording material is heated to a temperature T1 which is above a temperature T0, its transmittance will change from either (A) or (D) to (B), and if it is then cooled to room temperature, its transmittance, which in any case was (B), will stabilize at (D).

If, on the other hand, the thermoreversible recording material, the transmittance of which at room temperature was either (A) or (D), is heated above a temperature of T2 which is higher than temperatures T0 and T1, its transmittance, which was (A) or (D), will pass transmittance (B) and change to (C). That is, its transparency will decrease somewhat compared to (D). If it is then cooled to room temperature, its transmittance, which in any case was (C), will change to (A) and the thermoreversible recording material will stabilize at an opaque state (A).

The following examples of this property are disclosed in Japanese Patent Kokai Publication No. S55-154198 referred to above.

(1) When a thermoreversible recording material comprising a normal-chain copolyester of high molecular weight whose principal components are an aromatic dicarboxylic acid and an aliphatic diol, together with docosanoic acid, was heated to 72° C. and cooled, it exhibited a stable transparency. It was possible to return it to an opaque state only by re-heating it to a temperature of 77° C. or above.

(2) When a thermoreversible recording material comprising a copolymer of vinylidene chloride and acrylonitrile, together with docosanoic acid and a fluoride lubricant to improve fluidity, was heated to 63° C. and cooled, it exhibited a stable transparency. It was possible to return it to an opaque state only by re-heating it to a temperature of 74° C. or above.

(3) When a thermoreversible recording material comprising a copolymer of vinyl chloride and vinyl acetate, together with docosanol, was heated to 68° C. and cooled, it exhibited a stable transparency. It was possible to return it to an opaque state only by re-heating it to a temperature of 70° C. or above.

(4) When a thermoreversible recording material comprising a polyester together with docosanoic acid was heated to 72° C. and cooled, it exhibited a stable transparency. It was possible to return it to an opaque state only by re-heating it to a temperature of 77° C. or above.

Devices that record by image formation using heat-generating recording elements, on the other hand, are widely used because the heat-generating recording elements are inexpensive, the recording process is simple, and the price of the devices can be kept low. A well known method of this type is thermosensitive recording, which makes use of direct writing on thermally sensitive paper and finds application in telefax terminals and printers.

The recording paper used in this method is disclosed in Japanese Patent Kokoku Publication No. S45-14039, and uses a color-producing or developing reaction between a colorless die (leuco die), which serves as the electron donor, and a developer (a phenolic acid substance), which serves as the electron receptor, with a thermosensitive layer that assists the reactions between the two substances.

When heat energy from the heat-generating recording elements of a recording device is applied to this recording paper, the colorless die and developer melt and react to produce color. The difference in density between the portions in which color is produced and those in which it is not records characters and graphics in visible form.

However the range of temperatures within which thermoreversible recording materials according to the prior art will attain a transparent state is, as has been above described, extremely narrow: 5° C. (77°-72° C.) for case (1), 11° C. for case (2), 2° C. for case (3) and 5° C. for case (4), or at most only 11° C.

To achieve a display of excellent contrast using a display device using a thermoreversible recording material, it is desired to provide a colored plate at the back of the display plate formed of the thermoreversible recording material, and, by selectively making the printed portion of the display plate transparent with a thermal head or other heating means, and leaving the background portions opaque, so that the color of the colored plate is seen only through the printed portion.

However, the range of temperatures within which a transparent state can be attained using the thermoreversible recording materials according to the prior art is, as has been above described, narrow, making it difficult to exert the requisite temperature control over the thermal heads or like heating means and to obtain stable transparency when images are to be repeatedly formed.

Again, the contrast (ratio of transmittances between the transparent and opaque states) for the prior-art thermoreversible recording materials is not particularly large, and further improvement has been desired.

There has not been any recording device which performs display in visible form on cards, sheets, or other recording media, that is to say printing, and recovers this printed portion by erasing it in its entirety, thereby enabling new printing on the recovered portion.

Thus thermosensitive paper, once printed, can only be destroyed should the information no longer be required, and in the present era of information and communication, an enormous amount of paper to be disposed of have resulted in a growing consumption of natural resources. There has also been a growing trend to encourage the use of regenerated paper as a way of conserving natural resources, but the manufacture of regenerated paper also consumes resources.

It is therefore desirable to develop a reusable recording medium and associated printing device capable of printing on a recording medium in directly visible form, recovering it by erasing the printed portion in its entirety, and printing again onto the recovered portion.

SUMMARY OF THE INVENTION

It is therefore a first object of this invention to provide a thermoreversible recording material that can be made transparent over a wider temperature range and can exhibit higher contrast than materials according to the prior art.

It is a second object of the invention to provide a thermoreversible recording material that suffers smaller variations in the transparent state and the opaque state up to a higher temperature, e.g., 70° C.

It is a third object of this invention to provide a thermoreversible recording medium in the form of a card, a sheet or the like, which permits recording in visible form, and erasure of the entire recording for recovery, and new printing on the recovered portion; that is to say, which permits repeated printing in visible form on it.

It is a fourth object of this invention to provide a method of recording information using the above-mentioned thermoreversible recording material.

It is a fifth object of this invention to provide a method of recording information using the above-mentioned thermoreversible recording medium.

Thermoreversible Recording Material

This invention provides a thermoreversible recording material having its transparency changed in accordance with its thermal history, comprising a matrix material and an organic compound of low molecular weight, characterized in that the matrix material comprises polyvinyl acetal and the organic compound of low molecular weight comprises a saturated carboxylic acid or derivative thereof.

The saturated carboxylic acid should preferably has 10 to 40 carbon atoms.

Suitable saturated carboxylic acids which may be used in this invention include, but are not limited to, capric acid, lauric acid, myristic acid, palmitic acid, stearic acid, nonadecanoic acid, arachic acid, heneicosanoic acid, behenic acid, tricosanoic acid, lignoceric acid, pentacosanoic acid, cerotic acid, heptacosanoic acid, montanic acid, nonacosanoic acid, melissic acid, hentriacontanoic acid, lacceric acid, tritriacontanoic acid, geddic acid, ceroplastic acid, hexatriacontanoic acid, heptatriacontanoic acid, nonatriacontanoic acid and tetracontanoic acid. These compounds are saturated carboxylic acids having 10–40 carbon atoms.

Suitable derivatives of saturated carboxylic acids include, but are not limited to, amides such as stearic acid amide, nonadecanoic acid amide, arachic acid amide, heneicosanoic acid amide, behenic acid amide, tricosanoic acid amide, lignoceric acid amide, pentacosanoic acid amide, cerotic acid amide, heptacosanoic acid amide, montanic acid amide, nonacosanoic acid amide, melissic acid amide, hentriacontanoic acid amide, lacceric acid amide, tritriacontanoic acid amide, geddic acid amide, ceroplastic acid amide, hexatriacontanoic acid amide, heptatriacontanoic acid amide, nonatriacontanoic acid amide and tetracontanoic acid amide; amines such as dodecyl amine, hexadecyl amine, octadecyl amine, stearylamine, nonadecylamine, arachylamine, heneicosylamine, behenylamine, tricosylamine, lignocerylamine, pentacosylamine, cerylamine, heptacosylamine, montanylamine, nonacosylamine, melissylamine, hentriacontylamine, laccylamine, tritriacontylamine, geddylamine, ceroplastylamine, hexatriacontylamine, heptatriacontylamine, nonatriacontylamine and tetracontylamine; anilides such as palmitoanilide, stearylanilide, nonadecylanilide, arachylanilide, heneicosylanilide, behenylanilide, tricosylanilide, lignocerylanilide, pentacosylanilide, cerylanilide, heptacosylanilide, montanylanilide, nonacosylanilide, melissylanilide, hentriacontylanilide, laccelylanilide, tritriacontylanilide, geddylanilide, ceroplastylanilide, hexatriacontylanilide, heptatriacontylanilide, nonatriacontylanilide and tetracontylanilide; alcohols such as cetyl alcohol, stearyl alcohol, nonadecanol, eicosanol, heneicosanol, docosanol, tetratricosanol, pentatricosanol, hexatricosanol, heptatricosanol, octacosanol, nonacosanol, melissyl alcohol, hentriacontanol, laccerlol, tritriacontanol, tetracontanol, pentacontanol, hexacontanol, heptacontanol and nonatriacontanol; esters such as phenyl stearate, vinyl stearate, n-dodecyl stearate, methyl nonadecoate, methyl arachate, methyl heneicosanoate, methyl behenate, methyl tricosanoate, methyl lignocerate, methyl pentacosanoate, methyl cerotate, methyl heptacosanoate, methyl montanate, methyl nonacosanoate, methyl melissinate, methyl hentriacontanoate, methyl laccerate, methyl tritriacontanoate, methyl geddate, methyl ceroplastate, methyl hexatriacontanoate, methyl heptatriacontanoate, methyl nonatriacontanoate and methyl tetracontanoate; ketones such as sterone, 19-heptatriacontanone, 20-nonatriacontanone, 21-hentetracontanone and 22-tritetracontanone; metal salts such as calcium stearate, cobalt stearate, copper stearate, iron stearate, potassium stearate, lithium stearate, magnesium stearate, manganese stearate, nickel stearate, lead stearate, tin stearate, zinc stearate, zirconium stearate, calcium nonadecoate, calcium arachate, calcium heneicosanoate, calcium behenate, calcium tricosanoate, calcium lignocerate, calcium pentacosanoate, calcium cerotate, calcium heptacosanoate, calcium montanate, calcium nonacosanoate, calcium melissinate, calcium hentriacontanoate, calcium laccerate, calcium tritriacontanoate, calcium geddate, calcium ceroplastate, calcium hexatriacontanoate, calcium heptatriacontanoate, calcium nonatriacontanoate and calcium tetracontanoate; and imidazoles such as 2-heptadecyl imidazole, 2-undecyl imidazole and 2-stearyl imidazole.

These saturated carboxylic acids or these amide, amine, anilide, alcohol, ester, ketone, metal salt or imidazole which are derivatives of the above-mentioned saturated carboxylic acids may be used alone, or two or more of them may be used together in admixture.

FIG. 1 is a characteristic diagram showing the temperature dependence of light transmittance of an embodiment of thermoreversible recording material in which the matrix material consists essentially of polyvinyl acetal. It exhibits maximum transmittance, or assumes a "transparent state" when it is heated to a temperature range of T12=82° C. to T13=200° C. and cooled rapidly (i.e., at a rate of not less than 50° C./sec) to room temperature. It exhibits a minimum transmittance or assumes an "opaque state" when it is heated to the above described temperature range and then cooled slowly (i.e., at a rate of less than 50° C.) to room temperature. It is therefore possible to obtain a thermoreversible recording material wherein both the temperature range within which a transparent state is attained and the temperature range within which an opaque state is attained are broader than is the case with prior-art thermoreversible recording materials, and wherein the transparent and opaque states can be obtained by controlling the rate of cooling.

The temperature T12 can be adjusted by selection of the saturated carboxylic acid or its derivative.

It is desirable that the matrix material further contains a material selected from a group consisting of epoxy resin, phenol resin, epoxy compound, aldehyde compound and isocyanate compound.

It is desirable that the blending ratio in weight of polyvinylacetal and said material selected from said group is in the range 1:20–20:1.

Where said material selected from said group is epoxy compound, it is desirable that the epoxy group has a functional group represented by one of the following general formulae:

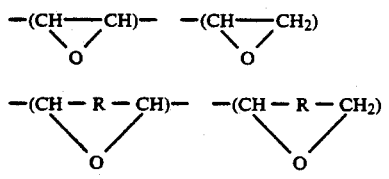

where R represents a hydrocarbon compound or its derivative.

Suitable epoxy compounds include, but are not limited to, monoepoxy compounds such as epoxypropane, epoxybutane, epoxypentane, epoxydodecane, epoxytetradodecane, epoxyhexadodecane, eopoxyoctadecane, epoxyeicosane, epoxydocosane, epoxytetracosane, allylglycidyl ether, 2-ethyl hexylglycidyl ether, phenyl glycidyl ether, phenol $(EO)_5$ glycidyl ether (EO=—$CH_2$—$CH_2$—O—C), p-tertiary butyl glycidyl ether, dibromophenyl glycidyl ether, and lauryl alcohol $(EO)_{15}$ glycidyl ether; and diepoxy compounds such as diepoxypropane, diepoxybutane, diepoxypentane, diepoxydodecane, diepoxytetradecane, diepoxyhexadecane, diepoxyoctadecane, diepoxyeicosane, diepoxydocosane, diepoxytetracosane, ethylene glycol diglycidyl ether, polyethylene glycol diglycidyl ether, propylene glycol diglycidyl ether, polypropylene glycol diglycidyl ether, neopentyl glycol diglycidyl ether, 1,6-hexanediol diglycidyl ether, bromo neopentyl diglycidyl ether, and o-phthalic acid diglycidyl ether; and polyepoxy compounds such as glycerol polyglycidyl ether, trimethylolpropane polyglycidyl ether, diglycerol polyglycidyl ether, polyglycerol polyglycidyl ether and sorbitol polyglycidyl ether.

Where said material selected from said group is an aldehyde compound, it is desirable that the aldehyde compound has a functional group represented by the general formula: —CHO.

Suitable aldehyde compounds include, but are not limited to, monoaldehyde compounds such as propanal, butanal, pentanal, dodecanal, tetradecanal, hexadecanal, octadecanal, eicosanal, docasanal, tetracosanal, isovanillin, phthalaldehydic acid, terephthalaldehydic acid, trimethoxybenzaldehyde, vanillin, benzoxybenzaldehyde, chlorosalicylaldehyde, dihydroxybenzaldehyde, anthraldehyde, ethylcarbazolecarboxyaldehyde, hydroxynaphthaldehyde, salicylaldehyde, cinnamaldehyde, acrylaldehyde, formylphenylacetic acid, dioxovaleric acid, formylsuccinic acid and aminobenzaldehyde; and dialdehyde compounds such as propanedial, butanedial, pentanedial, dodecanedial, tetradecanedial, hexadecanedial, octadecanedial, eicosanedial, docasanedial, tetracosanedial, isophthalaldehyde, terephthalaldehyde, naphthalene dialdehyde, glioxal and pyridine dicarboxyaldehyde.

Where said material selected from said group is an isocyanate compound, it is desirable that the isocyanate compound has a functional group represented by the general formula: —NCO.

Suitable isocyanate compounds include, but are not limited to, monoisocyanate compounds such as methyl isocyanate, ethyl isocyanate, propyl isocyanate, butyl isocyanate, pentyl isocyanate, dodecyl isocyanate, tetradecyl isocyanate, hexadecyl isocyanate, octadecyl isocyanate, eicosyl isocyanate, docosyl isocyanate, tetracosyl isocyanate, tolyl isocyanate, naphthyl isocyanate, nitrophenyl isocyanate, vinyl isocyanate and phenyl isocyanate; and diisocyanate compounds such as propane diisocyanate, butane diisocyanate, pentane diisocyanate, dodecane diisocyanate, tetradecane diisocyanate, hexadecane diisocyanate, octadecane diisocyanate, eicosane diisocyanate, docosane diisocyanate, tetracosane diisocyanate, dimethylbiphenyl diisocyanate, diphenylmethane diisocyanate, and hexamethylene diisocyanate.

The blending ratio in weight of saturated carboxylic acid or derivative thereof to the matrix material should be set within the range of 1:2 to 20:1. This is because if the blending ratio is more than 1:2, the formation of a film of the thermoreversible recording material is difficult, while if the blending ratio is less than 20:1, the thermoreversible property is inadequate.

Since in actual use, the thermoreversible recording material is to be overlaid onto a sheet, film or other substrate of an appropriate material, there may be occasion to prepare the coating solution of the thermoreversible recording material. In such a case, the matrix material and the saturated carboxylic acid or derivative thereof is dissolved in a solvent to obtain a coating solution. Solvents that may be used for this purpose may be selected from among, but need not be limited to, one of, or a mixture of two or more of, tetrahydrofuran, methyl ethyl ketone, methyl isobutyl ketone, chloroform, carbon tetrachloride, ethanol, toluene, and benzene. It is also permissible, when preparing the coating solution, to heat the solvent as required.

The thermoreversible recording material according to the invention in which the matrix material contains both polyvinyl acetal and a material selected from the group consisting of epoxy resin, phenol resin, epoxy compound, aldehyde compound and isocyanate compound has temperature versus temperature characteristics as shown in FIG. 2.

When the thermoreversible recording material is heated to above T22=120° C. and then cooled rapidly (i.e., at a rate of not less than 50° C./sec), the transmittance follows the curve (C) to (D), and the transmittance becomes maximum indicated by (D) when the room temperature (RT) is reached. When the material is heated to a temperature not lower than T21=80° C. and not higher than T22=120° C., and is cooled rapidly (at a rate not less than 50° C./sec) to room temperature, or heated above T22=120° C. and cooled slowly (at a rate less than 50° C./sec) to room temperature, the state of minimum transmittance indicated by (A), which is the opaque state is reached. The temperature range for forming the transparent state and the temperature range for forming the opaque state are both wider than with the prior-art thermoreversible recording material, and by controlling the rate of cooling the transparent state or the opaque state can be selectively created. Moreover, when the material is initially at the state (A), the opaque state is maintained from room temperature to the T21=80° C., and its variation is small and stable.

The temperatures T21 and T22 can be adjusted by selection of the specific kind of saturated carboxylic acid or its derivative, said material selected from said group consisting of epoxy resin, phenol resin, epoxy compound, aldehyde compound and isocyanate compound, and the blending ratio.

Thermoreversible Recording Medium

The invention also provides a thermoreversible recording medium comprising:

(1) a substrate; and (2) a thermoreversible recording/display layer that is superposed with the substrate layer and is made of a thermoreversible recording material whose transmittance varies with its thermal history;

with the thermoreversible recording material comprising a matrix material of polyvinyl acetal and a saturated carboxylic acid or derivative thereof.

The thermoreversible recording medium is typically in the form of sheet or card, and may additionally be provided with:

a reflecting/absorbing layer which reflects or absorbs light having passed through the thermoreversible recording/display layer, thereby providing better contrast for direct visual observation;

an enhancing layer which has an index of refraction sufficiently different from the index of refraction of the thermoreversible recording/display layer, thereby enhancing the contrast between transparent and opaque portions of the thermoreversible recording/display layer; and an encoded information recording layer for recording encoded information.

A protective layer may additionally be provided, as required, to cover the thermoreversible recording/display layer, the reflecting/absorbing layer, or the encoded information recording layer, where these layers are otherwise exposed, and where these layers need to be protected.

The substrate may be made of a material selected from among plastic and paper.

Suitable plastic materials include polyester, polyethylene, polypropylene, cellophane, polyvinyl chloride, polyolefin, polyvinyl alcohol, polyvinylidene chloride, polystyrene, polyamide, polycarbonate, polyacrylate, polysulfone, fluoride resin, polyacrylonitrile, polyethersulfone, polybutadiene and polyimide.

The film thickness of the substrate should such that the substrate is able to support the thermoreversible recording/display layer, and is preferably 25 μm–1 mm.

The substrate may be transparent, and may made of transparent plastic, such as, for example, polyester, polyethylene, polypropylene, cellophane, polyvinyl chloride, polyolefin, polyvinyl alcohol, polyvinylidene chloride, polystyrene, polyamide, polycarbonate, polyacrylate, polysulfone, fluoride resin, polyacrylonitrile, polyethersulfone, and polybutadiene.

The substrate may alternatively be made of a material selected from among inorganic fibrous paper of good thermal conductivity, ceramic sheet, metallic sheet, and plastic sheet in which is dispersed carbon black, metal powder or the like.

The substrate may comprise a planar light source of the edge-lighted type, in the form of a panel at one edge of which light, from the environment, for instance, is made incident. Light having entered the panel repeats reflection and diffusion inside the panel and is emitted through one principal surface of the panel so that the panel serves as a planar light source. The emitted light is in the direction normal to the direction in which the light is incident at the one edge.

The thermoreversible recording/display layer may be made of any of the materials described above.

The reflecting/absorbing layer may be a colored layer that is printed with black, red, blue, or other color presenting a strong contrast with white.

The reflecting/absorbing layer may be a colored layer that is printed in a plurality of colors presenting a strong contrast with white. That is, the entire area of the reflecting/absorbing layer may be divided into a plurality of sections which have different colors, so that the respective items or fields of visual information are seen in different colors. For instance, where the visual information consists of characters representing several fields of information, either the characters or their background in each field has a color different from the colors of other fields, facilitating recognition of information.

The reflecting/absorbing layer may be printed with a coating material containing a fluorescent coating material.

The reflecting/absorbing layer may be printed with a coating material containing carbon black or metallic powder having good thermal conductivity, to improve the thermal efficiency of the thermoreversible recording material.

The reflecting/absorbing layer may contain a metal such as aluminum or copper, a pigment or a dye.

Black, red or blue ink, or ink of other colors, can also be coated on the substrate by means of an ordinary gravure press for film.

It is desirable that the ink color gives high contrast on white when the thermoreversible recording/display material is opaque (dull white). The color of the ink may be black, red, green, blue, yellow or other colors.

The enhancing layer may be formed between the thermoreversible recording/display layer and the reflecting/absorbing layer. It serves to heighten the contrast between portions of higher and lower transmittances, i.e., transparent and opaque portions of the thermoreversible recording/display layer.

The materials suitable for the enhancing layer include a transparent plastic such as polyester, polyethylene, polypropylene, cellophane, polyvinyl chloride, polyolefin, polyvinyl alcohol, polyvinylidene chloride, polystyrene, polyamide, polycarbonate, polyacrylate, polysulfone, fluoride resin, polyacrylonitrile, polyethersulfone, and polybutadiene, or a transparent inorganic substance such as $SiO_2$.

Where the substrate is transparent, the transparent substrate may be interposed between the thermoreversible recording/display layer and the reflecting/absorbing layer, in which case the transparent substrate may serve also as an enhancing layer.

The enhancing layer may be formed of an air space. An air space can be formed by the use of a spacing layer formed between peripheral portions of the substrate and the reflecting/absorbing layer, or another pair of layers which would be adjacent to each other if the spacing layer were not interposed. With such a configuration, an air space separates the above-mentioned pair of layers. The air space having an index of refraction different from the index of refraction of the thermoreversible recording/display layer serves as an enhancing layer.

The transparent substrate serving as an enhancing layer may be used in addition to another enhancing layer. The enhancing layer formed of the air space may be used in combination with the enhancing layer consisting of a solid layer, either a layer whose sole function is the enhancement or a transparent substrate which also has the function of support.

The encoded information recording layer may comprise a recording medium such as a magnetic recording medium, thermal recording medium, optical recording medium, electrical recording medium such as IC memories used in IC cards, magneto-optical recording medium, or thermomagnetic recording medium.

With the encoded information recording layer, the recording medium according to the invention can make the recording of the encoded information in addition to the thermoreversible recording. This can widen the application of the medium of the invention. For instance, part of the information stored in the encoded information recording layer can be converted into a visual information and displayed on the thermoreversible recording/display layer, with the aid of a data processing terminal having the functions of reading the encoded information, converting the encoded information into the visual information, and writing the visual information into the thermoreversible recording/display layer. It is also possible to write the visual information into the thermoreversible recording/display layer after processing the encoded information read from the encoded information recording layer. Such functions are useful where the thermoreversible recording medium according to the invention is used as a prepaid card, or the like.

The thermoreversible recording/display layer and the encoded information recording layer may be provided on opposite sides of the substrate.

The materials suitable for the protective layer include a plastic such as polyester, polyethylene, polypropylene, cellophane, polyvinyl chloride, polyolefin, polyvinyl alcohol, polyvinylidene chloride, polystyrene, polyamide, polycarbonate, polyacrylate, polysulfone, fluoride resin, polyacrylonitrile, polyethersulfone, polybutadiene, polyimide or UV-cured resin, or of an inorganic substance such as $SiO_2$, $Al_2O_3$ or $TiO_2$.

The protective layer may be transparent. Particularly, the protective layer covering the thermoreversible recording/display layer should be transparent to permit direct observation.

The materials suitable for the transparent protective layer include a transparent plastic such as polyester, polyethylene, polypropylene, cellophane, polyvinyl chloride, polyolefin, polyvinyl alcohol, polyvinylidene chloride, polystyrene, polyamide, polycarbonate, polyacrylate, polysulfone, fluoride resin, polyacrylonitrile, polyethersulfone, polybutadiene, polyimide or UV-cured resin, or of a transparent inorganic substance such as $SiO_2$.

The thickness of the transparent protective layer should be such that a heat-emitting recording device can transmit heat to the thermoreversible recording/display layer through the protective layer, and is preferably 1–15 μm.

Characters and graphics may be printed on the transparent protective layer, the transparent substrate, or the planar light source. Such printing is desired where information that need not be altered or erased be provided on the thermoreversible recording medium.

Where the characters and graphics are printed on the side of the thermoreversible recording medium from which the visual information is observed, it may be desirable that the printing be made in only the peripheral areas of the transparent protective layer, or the transparent substrate, that is to say the area corresponding to the area of the thermoreversible recording/display layer where normally thermal recording is not made and where there is therefore no interference with the observation of the visual information. However, there may be situations where it is desired that characters, graphics, or lines forming frames are printed to overlap with the visual information on the thermoreversible recording/display layer or define areas of respective items or fields of visual information. In such a case, the printing may be made in the area corresponding to the area where the visual information is recorded in the thermoreversible recording/display layer.

It is possible to add information by handwriting on the transparent substrate or on the transparent protective layer using a water-based or an oil-based felt-tip pen. Such added information may be superimposed with the visual information of the thermoreversible recording/display layer. This arrangement is particularly advantageous where the thermoreversible recording medium of the invention is used in a projector, such as an overhead projector. To erase the handwritten information alcohol, water, or other solvent may be used. To repeat handwriting and erasure with the solvent, the layer on which the handwriting is made must be sufficiently thick. From this viewpoint, the arrangement where the handwriting is made on the transparent substrate which is relatively thick is advantageous.

Recording Method

The present invention also provides a recording method which comprises the steps of:

(1) heating a thermoreversible recording material of polyvinyl acetal and a saturated carboxylic acid or derivative thereof; and then (2) cooling the thermoreversible recording material at a controlled rate to control the transmittance of the thermoreversible recording material after the cooling.

The present invention also provides a recording method which comprises the steps of:

(1) heating a specific portion of a thermoreversible recording medium having a thermoreversible recording/display layer comprising a matrix material of polyvinyl acetal and a saturated carboxylic acid or derivative thereof; and then (2) cooling the thermoreversible recording medium at a controlled rate to control the transmittance of the specific portion of the thermoreversible recording medium.

When the thermoreversible recording material according to the present invention is heated to a certain temperature range and then cooled to room temperature, the transmittance after the cooling depends on the rate of cooling. If the cooling rate is high, e.g., not less than 50° C./sec the material exhibits a higher transmittance or assumes a transparent state. If the cooling rate is low, e.g., less than 50° C./sec, the material exhibits a lower transmittance or assumes an opaque state. Thus, by controlling the rate of cooling, the material can be made transparent or opaque at will.

In addition, some embodiments of the thermoreversible recording material according to the invention become opaque if they are heated a second temperature range lower than the first-mentioned temperature range and then cooled with any cooling rate.

By selectively heating respective portions of the thermoreversible recording medium according to the invention, visual information can be formed. For the selective heating, an array of heating elements, such as a thermal head used for thermal printing can be used.

For heating the entire thermoreversible recording medium, a heating roller or a heating block extending across the entire area of the thermoreversible recording/display layer may be used.

The rate of cooling can be controlled by the choice of heating means. When the thermal head or an array of heating elements is used, the heat capacity of each heating element is small, so each heating element quickly cools after applying heat to the thermoreversible recording medium. The thermoreversible recording medium is therefore cooled quickly. On the other hand, a heating roller or a heating block usually has a large heat capacity, so that it cools slowly once it has been heated. The thermoreversible recording medium is therefore cooled slowly.

In view of the features of the thermoreversible recording medium and the heating means, it is desirable that the heating roller or heating block be used for erasing the visual information throughout the entire area or certain section of the thermoreversible recording medium, and the thermal head or some other array of heating elements be used for writing visual information.

The thermal head used for in conventional thermal printing such as those used in facsimile machines and printers can be used for recording on the thermoreversible recording medium according to the invention. This is because the recording conditions of the thermoreversible recording medium coincide with the recording conditions of the conventional thermosensitive papers. The printing apparatus used for the thermosensitive papers can be used for the thermoreversible recording according to the present invention, without modification.

The visual information can be observed directly or with the use of projector, such as an overhead projector.

DETAILED DESCRIPTION OF THE PREFERRED EMBODIMENTS

Various embodiments will next be described, but the scope of the invention is not limited to the embodiments described.

Embodiment 1

The polyvinyl acetal used was SLEC KS-1 (tradename, manufactured by Sekisui Kagaku Kogyo Kabushiki Kaisha. Behenic acid was used as the saturated carboxylic acid. The coating solution for the thermoreversible recording material was prepared by dissolving 5 parts by weight of SLEC KS-1 and 3 parts by weight of behenic acid in 50 parts by weight of tetrahydrofuran (hereinafter abbreviated THF).

As Comparative Example 1A, a coating solution was prepared in the same way as the thermoreversible recording material coating solution of Embodiment 1, with the exception that behenic acid was not used; that is to say, by dissolving 5 parts by weight of SLEC KS-1 in 50 parts by weight of THF.

As Comparative Example 1B, a coating solution was prepared in the same way as the thermoreversible recording material coating solution of Embodiment 1, with the exception that 5 parts by weight of VYHH (tradename, manufactured by Union Carbide Corporation), which is a copolymer of vinyl chloride and vinyl acetate, was used instead of SLEC KS-1.

Next, the bar coating method was used to apply the coating solutions of Embodiment 1, Comparative Example 1A and Comparative Example 1B in identical thicknesses to a substrate made of polyethylene terephthalate, which is a kind of polyester. Drying time was so set as to remove THF which was the solvent.

Figure 1:
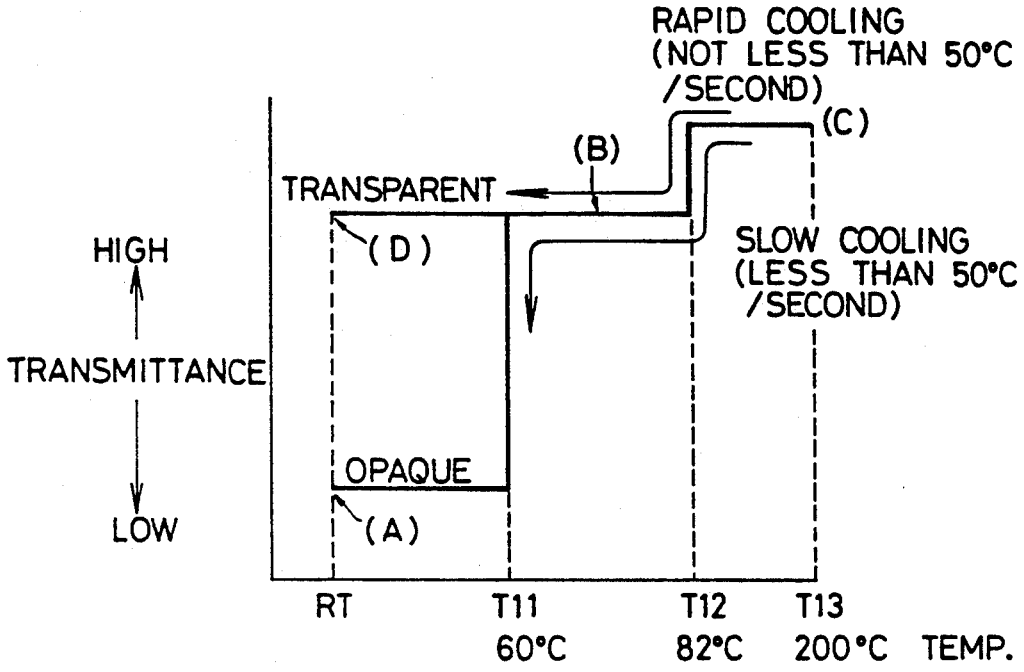
FIG. 1 is a characteristic diagram showing the light transmittance against temperature of a thermoreversible recording material according to Embodiment 1 of this invention.

The variation of transmittance against temperature was measured for the specimens thus formed, and hysteresis curves were plotted, with transmittance on the vertical axis and temperature on the horizontal. The hysteresis curve for the specimen of Embodiment 1 is as shown in FIG. 1. As can be understood from FIG. 1, when the specimen according to Embodiment 1 was heated to a range of temperature from T2=82° C. to T3=200° C., which is the softening temperature of SLEC KS-1, and then cooled rapidly (not less than 50° C./sec) to room temperature, it became transparent and stabilized in the transparent state. Again, when it was heated to a range of temperature from 82° C. to 200° C., and then cooled slowly (less than 50° C./sec) to room temperature, it became opaque and stabilized in the opaque state.

The contrast, for the specimen according to Embodiment 1, as represented by the ratio of transmittances in the transparent state and in the opaque state (in this case the ratio of transmittances of light having a wavelength of 550 nm), was 10.

In the case of the specimen according to the Comparative Example 1A, on the other hand, the coated film after formation from the coating solution was transparent, and even when its temperature was changed to the 20°–120° C. range and then cooled to room temperature it did not attain an opaque state.

Figure 27:
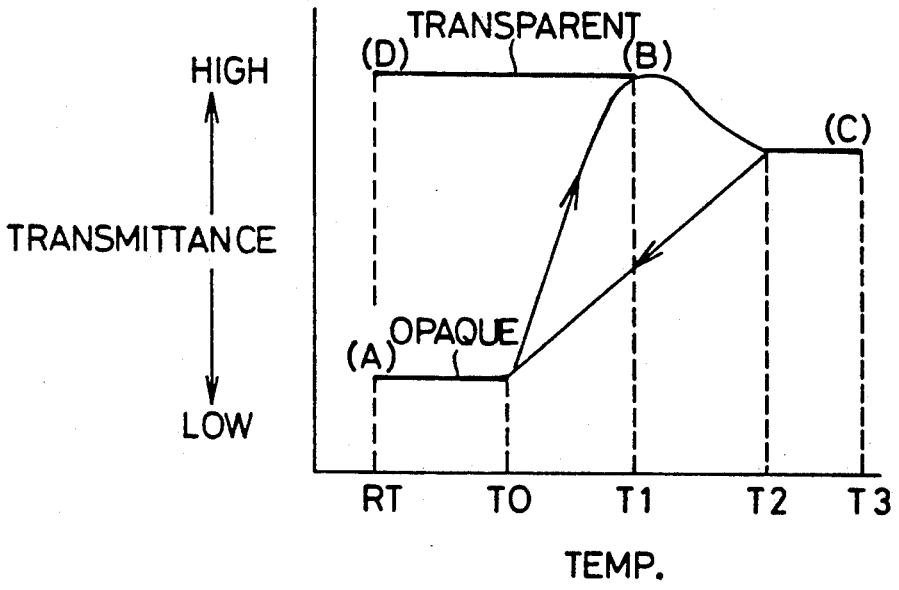
FIG. 27 PRIOR ART
FIG. 27 is a characteristic diagram showing the light transmittance against temperature of a thermoreversible recording material according to the prior art.

The hysteresis curve of the specimen according to the Comparative Example 1B was similar to the characteristics according to the prior art shown in FIG. 27, with the range of temperature for producing a transparent state was 80° to 82° C., which is narrow compared to that of Embodiment 1. The contrast was 4.0.

Table 1 below shows the characteristics of specimens according to Embodiment 1 and Comparative Examples 1A and 1B.

TABLE 1

| SPECIMEN | TEMPERATURE RANGE FOR PRODUCING TRANSPARENT STATE | TEMPERATURE RANGE FOR PRODUCING OPAQUE STATE | CONTRAST |
|---|---|---|---|
| EMBODIMENT 1 | 60 to 200° C. (ΔT = 140° C.) | 82 to 200° C. (ΔT = 118° C.) | 10 |
| COMPARATIVE EXAMPLE 1A | DID NOT BECOME OPAQUE | | |
| COMPARATIVE EXAMPLE 1B | 80 to 82° C. (ΔT = 3° C.) | 82 to 160° C. (ΔT = 78° C.) | 4 |

Embodiment 2

The polyvinyl acetal used was SLEC KS-1. Epoxy resin used was EPOMIK R309 (tradename, manufactured by Mitsui Sekiyu Kagaku Kogyo Kabushiki Kaisha). Behenic acid was used as the saturated carboxylic acid. The coating solution for the thermoreversible recording material according to Embodiment 2 was prepared by dissolving 5 parts by weight of SLEC KS-1, 5 parts by weight of EPOMIK R309 and 3 parts by weight of behenic acid in 50 parts by weight of THF.

As Comparative Example 2, a coating solution was prepared in the same way as the thermoreversible recording material coating solution of Embodiment 2, with the exception that 10 parts by weight of SARAN F310 (manufactured by Dow Chemical Company) which is a copolymer of vinylidene chloride and acrylonitrile was used in place of SLEC KS-1, and EPOMIK R309.

Next, the bar coating method was used to apply the coating solutions of Embodiment 2, and Comparative Example 2 in identical thicknesses to a substrate made of polyethylene terephthalate. Drying time was so set as to remove THF which was the solvent.

The variation of transmittance against temperature was measured for the specimens thus formed, and hysteresis curves were plotted, with transmittance on the vertical axis and temperature on the horizontal. The hysteresis curve for the specimens of Embodiment 2 is as shown in FIG. 2.

Figure 2:
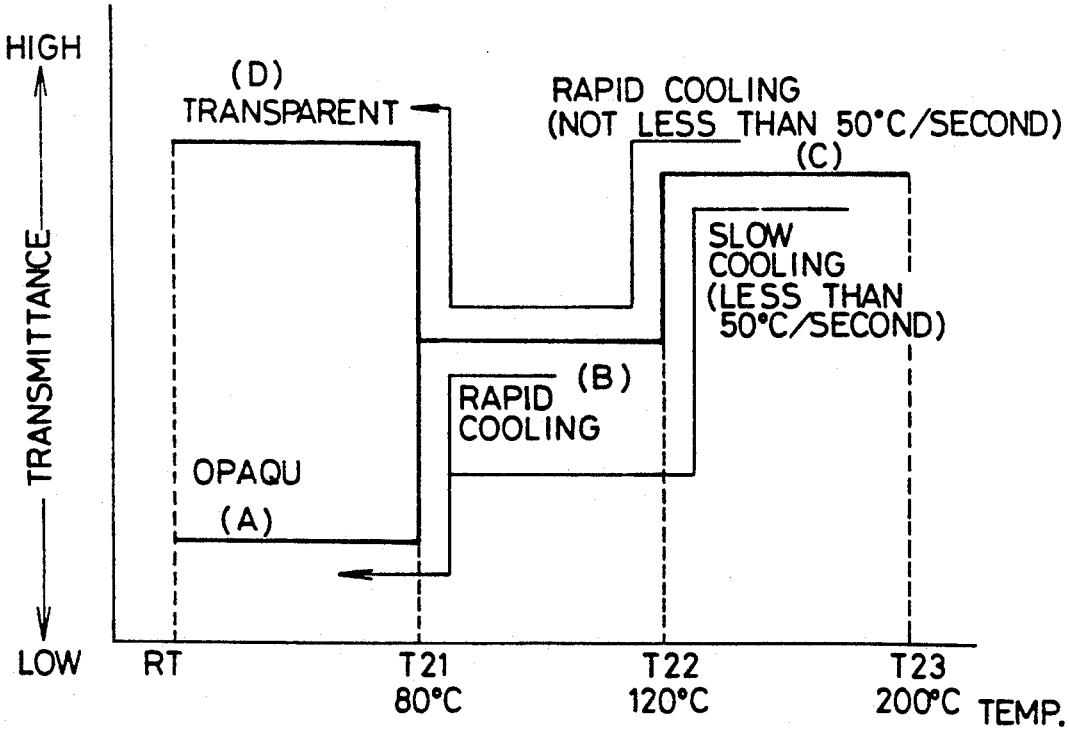
FIG. 2 is a characteristic diagram showing the light transmittance against temperature of a thermoreversible recording material according to Embodiment 2 of this invention.

As can been seen from FIG. 2, when the specimen according to Embodiment 2 was heated to a temperature in the range from 120° C. to 200° C., which is the softening temperature of SLEC KS-1, and then cooled rapidly (not less than 50° C./sec) to room temperature, it became transparent and stabilized in the transparent state. When it was heated to a range of temperature from T21=80° C. to T22=120° C. and then cooled to room temperature at any cooling rate, or heated to a range of temperature from T22=80° C. to T23=200° C., and then cooled slowly (less than 50° C./sec) to room temperature, it became opaque and stabilized in the opaque state.

The contrast for the specimen according to Embodiment 2, as represented by the ratio of transmittances in the transparent state and in the opaque state (in this case the ratio of transmittances of light having a wavelength of 550 nm), was 10.

The hysteresis curve of the specimen according to the Comparative Example 2 was similar to that shown in FIG. 27, and the range of temperature for producing the transparent state was 63° to 74° C., which is narrow compared to that of the Embodiment 2. The contrast was 6.

The characteristics of the specimens of the Embodiment 2 and the Comparative Example 2 are shown in Table 2A.

TABLE 2A

| SPECIMEN | TEMPERATURE RANGE FOR PRODUCING TRANSPARENT STATE | TEMPERATURE RANGE FOR PRODUCING OPAQUE STATE | CONTRAST |
|---|---|---|---|
| EMBODIMENT 2 | 120 to 200° C. (ΔT = 80° C.) | 80 to 200° C. (ΔT = 120° C.) | 10 |
| COMPARATIVE EXAMPLE 2 | 63 to 74° C. (ΔT = 11° C.) | 82 to 160° C. (ΔT = 78° C.) | 6 |

The variations of the transparent state and the opaque state of the Embodiment 2 and the Comparative Example 2 due to aging with respective temperatures (40°, 50°, 60° and 70° C.), after a predetermined time (100 hours) are shown in Table 2B.

TABLE 2B

| | INITIAL VALUE | 40° C. | 50° C. | 60° C. | 70° C. |
|---|---|---|---|---|---|
| EMBODIMENT 2 | | | | | |
| TRANSPARENT STATE | 50% | 50% | 50% | 50% | 50% |
| OPAQUE STATE | 5% | 5% | 5% | 5% | 5% |
| CONTRAST | 10 | 10 | 10 | 10 | 10 |
| COMPARATIVE EXAMPLE 2 | | | | | |
| TRANSPARENT STATE | 60% | 60% | 60% | 60% | 60% |
| OPAQUE STATE | 10% | 20% | 30% | 60% | 60% |
| CONTRAST | 6 | 3 | 2 | 1 | 1 |

It is seen from Table 2B that the aging changes of the specimens according to Embodiment 2 are smaller than the aging changes of the specimens of Comparative Example 2.

Embodiment 3

The polyvinyl acetal used was SLEC KS-1. Phenol resin used was PLYOPHEN 5030 (tradename, manufactured by Dainippon Ink Kagaku Kogyo Kabushiki Kaisha). Behenic acid was used as the saturated carboxylic acid. The coating solution for the termoreyersible recording material according to Embodiment 3 was prepared by dissolving 5 parts by weight of SLEC KS-1, 5 parts by weight of PLYOPHEN 5030 and 3 parts by weight of behenic acid in 50 parts by weight of THF.

As Comparative Example 3, a coating solution was prepared in the same way as the thermoreversible recording material coating solution of Embodiment 3, with the exception that 10 parts by weight of SARAN F310 which is a copolymer of vinylidene chloride and acrylonitrile was used in place of SLEC KS-1, and PLYOPHEN 5030.

Next, in the same way as Embodiment 2, the coating solutions of Embodiment 3 and Comparative Example 3 were applied to a substrate and dried to obtain respective specimens.

The variation of transmittance against temperature was measured for the specimens thus formed, and hysteresis curves were plotted, with transmittance on the vertical axis and temperature on the horizontal. The hysteresis curve for the specimens of Embodiment 3 is as shown in FIG. 2. That is, it is similar to that of Embodiment 2.

The contrast for the specimen according to Embodiment 3, as represented by the ratio of transmittances in the transparent state and in the opaque state (in this case the ratio of transmittances of light having a wavelength of 550 nm), was 7.1.

The hysteresis curve of the speciment according to the Comparative Example 3 was similar to that shown in FIG. 27, and the values of T0, T1, T2 and T3 were 40° C., 63° C., 74° C. and 160° C., respectively. The range of temperature for producing the transparent state was 63° to 74° C., which is narrow. The contrast was 6. The characteristics of the specimens of the Embodiment 3 and the Comparative Example 3 are shown in Table 3A.

TABLE 3A

| SPECIMEN | TEMPERATURE RANGE FOR PRODUCING TRANSPARENT STATE | TEMPERATURE RANGE FOR PRODUCING OPAQUE STATE | CONTRAST |
|---|---|---|---|
| EMBODIMENT 3 | 120 to 200° C. (ΔT = 80° C.) | 80 to 200° C. (ΔT = 120° C.) | 7.1 |
| COMPARATIVE EXAMPLE 3 | 63 to 74° C. (ΔT = 11° C.) | 74 to 160° C. (ΔT = 86° C.) | 6 |

The variations of the transparent state and the opaque state of the Embodiment 3 and the Comparative Example 3 due to aging with respective temperatures (40°, 50°, 60° and 70° C.), after a predetermined time (100 hours) are shown in Table 3B.

TABLE 3B

| | INITIAL VALUE | 40° C. | 50° C. | 60° C. | 70° C. |
|---|---|---|---|---|---|
| EMBODIMENT 3 | | | | | |
| TRANSPARENT STATE | 50% | 50% | 50% | 50% | 50% |
| OPAQUE STATE | 7% | 7% | 7% | 7% | 7% |

TABLE 3B-continued

| | INITIAL VALUE | 40° C. | 50° C. | 60° C. | 70° C. |
|---|---|---|---|---|---|
| CONTRAST | 7.1 | 7.1 | 7.1 | 7.1 | 7.1 |
| COMPARATIVE EXAMPLE 3 | | | | | |
| TRANSPARENT STATE | 60% | 60% | 60% | 60% | 60% |
| OPAQUE STATE | 10% | 20% | 30% | 60% | 60% |
| CONTRAST | 6 | 3 | 2 | 1 | 1 |

It is seen from Table 3B that the aging changes of the specimens according to Embodiment 3 are smaller than the aging changes of the specimens of Comparative Example 3.

Embodiment 4

The polyvinyl acetal used was SLEC KS-1. Monoepoxy compound used was DENACOL EX 111 (tradename, manufactured by Nagase Kasei Kogyo Kabushiki Kaisha), which is an allylglycidyl ether. Behenic acid was used as the saturated carboxylic acid. Three plurality of coating solutions, No. 1, No. 2 and No. 3, for the thermoreversible recording material according to Embodiment 4 were prepared. The coating solution No. 1 was prepared by dissolving 5 parts by weight of SLEC KS-1, 5 parts by weight of DENACOL EX 111 and 3 parts by weight of behenic acid in 50 parts by weight of THF.

The coating solution No. 2 was prepared in the same manner as above, except that diepoxy compound was used in place of the monoepoxy compound, and DENACOL EX 810 (tradename, manufactured by Nagase Kasei Kogyo Kabushiki Kaisha), which is an ethylene glycol diglycidyl ether, was used as the diepoxy compound.

The coating solution No. 3 was prepared in the same manner as above, except that diepoxy compound was used in place of the monoepoxy compound, and DENACOL EX 313 (tradename, manufactured by Nagase Kasei Kogyo Kabushiki Kaisha), which is a glycerol polyglycidyl ether, was used as the diepoxy compound.

As Comparative Example 4, a coating solution, No. 4, was prepared in the same way as the coating solution No. 1, with the exception that 10 parts by weight of SARAN F310 which is a copolymer of vinylidene chloride and acrylonitrile was used in place of polyvinyl acetal (SLEC KS-1), and the epoxy compound.

Next, in the same way as Embodiment 2, the coating solutions No. 1, No. 2 and No. 3 of Embodiment 4 and the coating solution No. 4 of Comparative Example 4 were applied to a substrate and dried to obtain respective specimens.

The variation of transmittance against temperature was measured for the specimens thus formed, and hysteresis curves were plotted, with transmittance on the vertical axis and temperature on the horizontal. The hysteresis curve for the specimens of Embodiment 4 is as shown in FIG. 2. That is, it is similar to that of Embodiment 2.

The contrasts for the specimens prepared from the coating solutions No. 1, No. 2 and No. 3 according to Embodiment 4, as represented by the ratio of transmittances in the transparent state and in the opaque state (in this case the ratio of transmittances of light having a wavelength of 550 nm), were 6.25, 7.1 and 10, respectively.

The hysteresis curve of the specimen according to the Comparative Example 4 was similar to that shown in FIG. 27, and the values of T0, T1, T2 and T3 were 40° C., 63° C., 74° C. and 160° C., respectively. The range of temperature for producing the transparent state was 63° to 74° C., which is narrow. The contrast was 6. The characteristics of the specimens formed from the coating solutions No. 1, No. 2 and No. 3 of the Embodiment 4 and the coating solution No. 4 of the Comparative Example 4 are shown in Table 4A.

TABLE 4A

| SPECIMEN | TEMPERATURE RANGE FOR PRODUCING TRANSPARENT STATE | TEMPERATURE RANGE FOR PRODUCING OPAQUE STATE | CONTRAST |
|---|---|---|---|
| EMBODIMENT 4 | 120 to 200° C. (ΔT = 80° C.) | 80 to 200° C. (ΔT = 120° C.) | |
| No. 1 | | | 6.25 |
| No. 2 | | | 7.1 |
| No. 3 | | | 10 |
| COMPARATIVE EXAMPLE 4 No. 4 | 63 to 74° C. (ΔT = 11° C.) | 74 to 160° C. (ΔT = 86° C.) | 6 |

The variations of the transparent state and the opaque state of the Embodiment 4 and the Comparative Example 4 due to aging with respective temperatures (40°, 50°, 60° and 70° C.), after a predetermined time (100 hours) are shown in Table 4B.

TABLE 4B

| | INITIAL VALUE | 40° C. | 50° C. | 60° C. | 70° C. |
|---|---|---|---|---|---|
| EMBODIMENT 4 No. 1 | | | | | |
| TRANSPARENT STATE | 50% | 50% | 50% | 50% | 50% |
| OPAQUE STATE | 8% | 8% | 8% | 8% | 8% |
| CONTRAST | 6.25 | 6.25 | 6.25 | 6.25 | 6.25 |
| EMBODIMENT 4 No. 2 | | | | | |
| TRANSPARENT STATE | 50% | 50% | 50% | 50% | 50% |
| OPAQUE STATE | 7% | 7% | 7% | 7% | 7% |
| CONTRAST | 7.1 | 7.1 | 7.1 | 7.1 | 7.1 |
| EMBODIMENT 4 No. 3 | | | | | |
| TRANSPARENT STATE | 50% | 50% | 50% | 50% | 50% |
| OPAQUE STATE | 5% | 5% | 5% | 5% | 5% |
| CONTRAST | 10 | 10 | 10 | 10 | 10 |
| COMPARATIVE EXAMPLE 4 No. 4 | | | | | |
| TRANSPARENT STATE | 60% | 60% | 60% | 60% | 60% |
| OPAQUE STATE | 10% | 20% | 30% | 60% | 60% |
| CONTRAST | 6 | 3 | 2 | 1 | 1 |

It is seen from Table 4B that the aging changes of the specimens according to Embodiment 4 are smaller than the aging changes of the specimens of Comparative Example 4.

Embodiment 5

The polyvinyl acetal used was SLEC KS-1. Monoaldehyde compound used was aminobenzaldehyde. Behenic acid was used as the saturated carboxylic acid. Two coating solutions, No. 5 and No. 6, for the thermoreversible recording material according to Embodiment 5 were prepared. The coating solution No. 5 was prepared by dissolving 5 parts by weight of SLEC KS-1, 5 parts by weight of aminobenzaldehyde and 3 parts by weight of behenic acid in 50 parts by weight of THF.

The coating solution No. 6 was prepared in the same manner as above, except that dialdehyde compound was used in place of the monoaldehyde compound, and terephtalaldehyde.

As Comparative Example 5, a coating solution, No. 7, was prepared in the same way as the coating solution (No. 5), with the exception that 10 parts by weight of SARAN F310 which is a copolymer of vinylidene chloride and acrylonitrile was used in place of polyvinyl acetal (SLEC KS-1), and the aldehyde compound.

Next, in the same way as Embodiment 2, the coating solutions No. 5 and No. 6 of Embodiment 5 and the coating solution No. 7 of Comparative Example 5 were applied to a substrate and dried to obtain respective specimens.

The variation of transmittance against temperature was measured for the specimens thus formed, and hysteresis curves were plotted, with transmittance on the vertical axis and temperature on the horizontal. The hysteresis curve for the specimens of Embodiment 5 is as shown in FIG. 2. That is, it is similar to that of Embodiment 2.

The contrasts for the specimens prepared from the coating solutions No. 5 and No. 6 according to Embodiment 5, as represented by the ratio of transmittances in the transparent state and in the opaque state (in this case the ratio of transmittances of light having a wavelength of 550 nm), were 7.1 and 10, respectively.

The hysteresis curve of the specimen prepared from the coating solution No. 7 according to the Comparative Example 5 was similar to that shown in FIG. 27, and the values of T0, T1, T2 and T3 were 40° C., 63° C., 74° C. and 160° C., respectively. The range of temperature for producing the transparent state was 63° to 74° C., which is narrow. The contrast was 6. The characteristics of the specimens of the Embodiment 5 and the Comparative Example 5 are shown in Table 5A.

TABLE 5A

| SPECIMEN | TEMPERATURE RANGE FOR PRODUCING TRANSPARENT STATE | TEMPERATURE RANGE FOR PRODUCING OPAQUE STATE | CONTRAST |
|---|---|---|---|
| EMBODIMENT 5 | 120 to 200° C. (ΔT = 80° C.) | 80 to 200° C. (ΔT = 120° C.) | |
| No. 5 | | | 7.1 |
| No. 6 | | | 10 |
| COMPARATIVE EXAMPLE 5 No. 7 | 63 to 74° C. (ΔT = 11° C.) | 74 to 160° C. (ΔT = 86° C.) | 6 |

The variations of the transparent state and the opaque state of the Embodiment 5 and the Comparative Example 5 due to aging with respective temperatures (40°, 50°, 60° and 70° C.), after a predetermined time (100 hours) are shown in Table 5B.

TABLE 5B

| | INITIAL VALUE | 40° C. | 50° C. | 60° C. | 70° C. |
|---|---|---|---|---|---|
| EMBODIMENT 5 | | | | | |
| No. 5 | | | | | |
| TRANSPARENT STATE | 50% | 50% | 50% | 50% | 50% |
| OPAQUE STATE | 7% | 7% | 7% | 7% | 7% |
| CONTRAST | 7.1 | 7.1 | 7.1 | 7.1 | 7.1 |
| EMBODIMENT 5 | | | | | |

TABLE 5B-continued

| | INITIAL VALUE | 40° C. | 50° C. | 60° C. | 70° C. |
|---|---|---|---|---|---|
| No. 6 | | | | | |
| TRANSPARENT STATE | 50% | 50% | 50% | 50% | 50% |
| OPAQUE STATE | 5% | 5% | 5% | 5% | 5% |
| CONTRAST | 10 | 10 | 10 | 10 | 10 |
| COMPARATIVE EXAMPLE 5 | | | | | |
| No. 7 | | | | | |
| TRANSPARENT STATE | 60% | 60% | 60% | 60% | 60% |
| OPAQUE STATE | 10% | 20% | 30% | 60% | 60% |
| CONTRAST | 6 | 3 | 2 | 1 | 1 |

It is seen from Table 5B that the aging changes of the specimens according to Embodiment 5 are smaller than the aging changes of the specimens of Comparative Example 5.

Embodiment 6

The polyvinyl acetal used was SLEC KS-1. Monoisocyanate compound used was octadecyl isocyanate. Behenic acid was used as the saturated carboxylic acid. Two The coating solution, No. 8 and No. 9, for the thermoreversible recording material according to Embodiment 6 were prepared. The coating solution No. 8 was prepared by dissolving 5 parts by weight of SLEC KS-1, 5 parts by weight of octadecyl isocyanate and 3 parts by weight of behenic acid in 50 parts by weight of THF.

The coating solution No. 9 for the thermoreversible recording material according to Embodiment 6 was prepared in the same manner as the manner described above, except that dimethylbiphenyl diisocyanate was used in place of the monoisocyanate compound.

As Comparative Example 6, a coating solution No. 10 was prepared in the same way as the coating solution No. 10, with the exception that 10 parts by weight of SARAN F310 which is a copolymer of vinylidene chloride and acrylonitrile was used in place of polyvinyl acetal (SLEC KS-1), and the isocyanate compound.

Next, in the same way as Embodiment 2, the coating solutions No. 8 and No. 9 of Embodiment 6 and the coating solution No. 10 of Comparative Example 6 were applied to a substrate and dried to obtain respective specimens.

The variation of transmittance against temperature was measured for the specimens thus formed, and hysteresis curves were plotted, with transmittance on the vertical axis and temperature on the horizontal. The hysteresis curve for the specimens of Embodiment 6 is as shown in FIG. 2. That is, it is similar to that of Embodiment 2.

The contrasts for the specimens prepared from the coating solutions No. 8 and No. 9 according to Embodiment 6, as represented by the ratio of transmittances in the transparent state and in the opaque state (in this case the ratio of transmittances of light having a wavelength of 550 nm), were 8 and 9, respectively.

The hysteresis curve of the specimen prepared from the coating solution No. 10 according to the Comparative Example 5 as similar to that shown in FIG. 27, and the values of T0, T1, T2 and T3 were 40° C., 63° C., 74° C. and 160° C., respectively. The range of temperature for producing the transparent state was 63° to 74° C., which is narrow. The contrast was 6. The characteristics of the specimens of the Embodiment 6 and the Comparative Example 6 are shown in Table 6A.

TABLE 6A

| SPECIMEN | TEMPERATURE RANGE FOR PRODUCING TRANSPARENT STATE | TEMPERATURE RANGE FOR PRODUCING OPAQUE STATE | CONTRAST |
|---|---|---|---|
| EMBODIMENT 6 No. 8 | 120 to 200° C. (ΔT = 80° C.) | 80 to 200° C. (ΔT = 120° C.) | 8 |
| No. 9 | | | 9 |
| COMPARATIVE EXAMPLE 6 No. 10 | 63 to 74° C. (ΔT = 11° C.) | 74 to 160° C. (ΔT = 86° C.) | 6 |

The variations of the transparent state and the opaque state of the Embodiment 6 and the Comparative Example 6 due to aging with respective temperatures (40°, 50°, 60° and 70° C.), after a predetermined time (100 hours) are shown in Table 6B.

TABLE 6B

| | INITIAL VALUE | 40° C. | 50° C. | 60° C. | 70° C. |
|---|---|---|---|---|---|
| EMBODIMENT 6 No. 8 | | | | | |
| TRANSPARENT STATE | 40% | 40% | 40% | 40% | 40% |
| OPAQUE STATE | 5% | 5% | 5% | 5% | 5% |
| CONTRAST | 8 | 8 | 8 | 8 | 8 |
| EMBODIMENT 6 No. 9 | | | | | |
| TRANSPARENT STATE | 45% | 45% | 45% | 45% | 45% |
| OPAQUE STATE | 5% | 5% | 5% | 5% | 5% |
| CONTRAST | 9 | 9 | 9 | 9 | 9 |
| COMPARATIVE EXAMPLE 6 No. 10 | | | | | |
| TRANSPARENT STATE | 60% | 60% | 60% | 60% | 60% |
| OPAQUE STATE | 10% | 20% | 30% | 60% | 60% |
| CONTRAST | 6 | 3 | 2 | 1 | 1 |

It is seen from Table 6B that the aging changes of the specimens according to Embodiment 6 are smaller than the aging changes of the specimens of Comparative Example 6.

Embodiment 7

Figure 3:
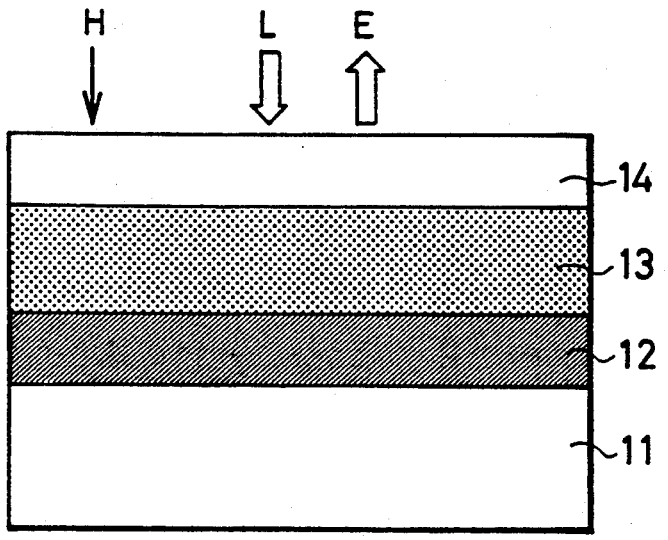
FIG. 3 is a sectional view showing the structure of a thermoreversible recording medium according to Embodiment 7.

FIG. 3 is a sectional view showing the structure of a thermoreversible recording medium according to Embodiment 7 of this invention. Embodiment 7 will be described with reference to FIG. 3.

This thermoreversible recording medium has a substrate 11 made from, for example, plastic sheet of a thickness of 100 μm. Over and adjacent to the substrate 11 is formed a reflecting/absorbing layer 12 which is printed in black, allowing it to act as a light-absorbing layer. Over and adjacent to the reflecting/absorbing layer 12 is formed a thermoreversible recording/display layer 13 of a thickness of 20 μm. Over and adjacent to the reflecting/absorbing layer 12 is formed a transparent protective layer 14 made of plastic sheet of a thickness of 5 μm.

The material of substrate 11 may be a plastic, such as polyester, polyethylene, polypropylene, cellophane, polyvinyl chloride, polyolefin, polyvinyl alcohol, polyvinylidene chloride, polystyrene, polyamide, polycarbonate, polyacrylate, polysulfone, fluoride resin, polyacrylonitrile, polyethersulfone, polybutadiene, polyimide, or paper or the like.

The thickness of the substrate 11 should be such that the substrate 11 can support the thermoreversible recording/display layer 13, and is preferably 25 μm–1 mm.

The reflecting/absorbing layer 12 may be of metal such as aluminum or copper, or material containing pigment, dye or the like. It is also possible to apply black or red ink using an ordinary gravure printing press for film. It is preferred that this color be such as to provide a good contrast with white exhibited by the thermoreversible recording/display layer 13 when it is opaque. The color of the reflecting/absorbing layer 12 may be black, red, green, blue, yellow, or some other colors.

It is also possible to print a plurality of colors having a good contrast with white. That is, the entire area of the reflecting/absorbing layer may be divided into a plurality of sections which have different colors, so that the respective items or fields of visual information are seen in different colors. For instance, where the visual information consists of characters representing several fields of information, either the characters or their background in each field has a color different from the colors of other fields, facilitating recognition of information.

It is also possible to use a coating containing carbon black or metal powder, which has thermal conductivity. In this case, the thermal efficiency of the thermoreversible recording medium is improved.

The material of the thermoreversible recording/display layer 13 may be any of the thermoreversible recording materials described in connection with the Embodiment 1 to Embodiment 6. For instance, a thermoreversible recording material comprising 5 parts by weight of SLEC KS-1 as a polyvinyl acetal, 5 parts by weight of EPOMIK R309 as an epoxy resin and 3 parts by weight of behenic acid, which is the thermoreversible recording material according to Embodiment 2, is used, and dissolved in 50 parts by weight of THF to form a solution, and the thermoreversible recording/display layer 13 is formed by applying this solution by bar coating method so that the film thickness after drying is 20 μm.

The transparent protective layer 14 may be of a transparent plastic such as polyester, polyethylene, polypropylene, cellophane, polyvinyl chloride, polyolefin, polyvinyl alcohol, polyvinylidene chloride, polystyrene, polyamide, polycarbonate, polyacrylate, polysulfone, fluoride resin, polyacrylonitrile, polyether sulfone, polybutadiene, polyimide or UV-cured resin.

The thickness of transparent protective layer 14 should be such as to permit the transmission of heat from the heat generating recording element through transparent protective layer 14 to thermoreversible recording/display layer 13, and is preferably 1–15 μm.

It is also possible, if required, to print characters or graphics on the peripheral portion of transparent protective layer 14, that is to say the area of the transparent protective layer 14 corresponding to the area of the thermoreversible recording/display layer 13 where normally thermal recording is not made and where therefore the transparent protective layer 14 need not permit observation of the printed recording. It is thus possible, by the use of normal printing in addition to thermally printed recording, to record information that need not be altered or erased.

It is possible to add information by handwriting with water-based or oil-based felt-tip pen or the like on the transparent protective layer 14.

It is also possible, if required, to form an adhesive layer over and adjacent to thermoreversible recording-/display layer 13, and another adhesive layer beneath and adjacent to the thermoreversible recording/display layer 13. These adhesive layers serve to strengthen the bonding force between the layers. It is also possible to form a printed layer over the adhesive layer that has been formed over thermoreversible recording/display layer 13.

If recording to a thermoreversible recording medium according to Embodiment 7 is performed by heating by means of a thermal head from the side of the transparent protective layer 14, as indicated by "H" in FIG. 3, heat will be efficiently transmitted to thermoreversible recording/display layer 13.

Visible information may be obtained by viewing the thermoreversible recording medium from above, i.e., from the side of the transparent protective layer 14, as indicated by "E" in FIG. 3, when under illumination from the side of the transparent protective layer 14, as indicated by "L" in FIG. 3.

The terms "over" and "beneath" were used for describing the relative position between layers. This however is by way of convenience and for easier understanding with regard to the illustration in the drawings. This should not be construed that the thermoreversible recording medium is used only in the illustrated attitude. Where however the visual information displayed by the thermoreversible recording/display layer is directly seen by the user, the upper side is the side from which the medium is seen.

Embodiment 8

Figure 4:
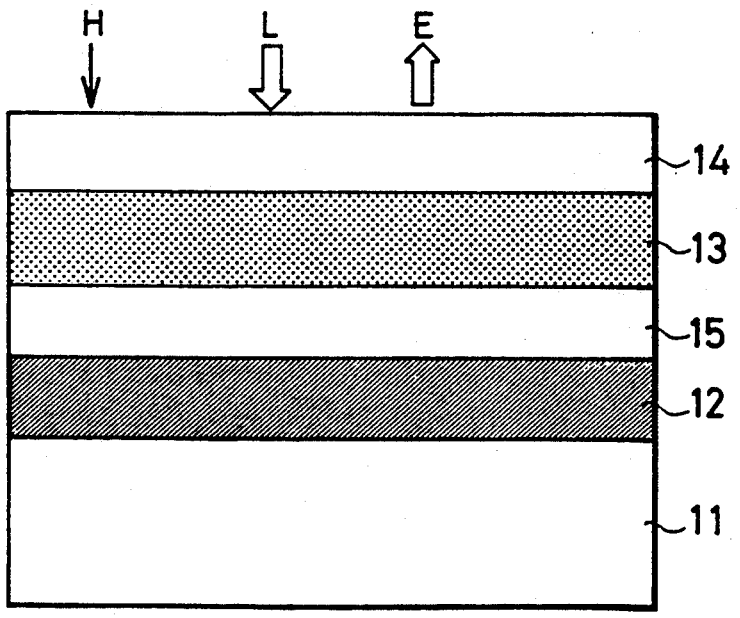
FIG. 4 is a sectional view showing the structure of a thermoreversible recording medium according to Embodiment 8.

FIG. 4 is a sectional view showing the structure of a thermoreversible recording medium according to Embodiment 8 of this invention.

The layer structure of the thermoreversible recording medium according to Embodiment 8 is identical to the layer structure of the thermoreversible recording medium according to Embodiment 7 (FIG. 3), except that an enhancing layer 15 is formed between reflecting-/absorbing layer 12 and thermoreversible recording-/display layer 13.

Enhancing layer 15 is provided to heighten the contrast between the portions of higher and lower light transmittances, i.e., transparent and opaque portions.

To provide the function of heightening the contrast, enhancing layer 15 should have an index of refraction sufficiently different from the index of refraction of the layer over and adjacent it, which in the illustrated embodiment is the thermoreversible recording/display layer 13. This applies to all the subsequently-described embodiments with an enhancing layer.

The material of enhancing layer 15 may be a transparent plastic as, for example, polyester, polyethylene, polypropylene, cellophane, polyvinyl chloride, polyolefin, polyvinyl alcohol, polyvinylidene chloride, polystyrene, polyamide, polycarbonate, polyacrylate, polysulfone, fluoride resin, polyacrylonitrile, polyethersulfone, or polybutadiene. Enhancing layer 15 may also be a layer of air.

If recording to a thermoreversible recording medium according to Embodiment 8 is performed by heating by means of a thermal head from the side of the transparent protective layer 14, as indicated by "H", heat will be efficiently transmitted to thermoreversible recording-/display layer 13.

Visible information may be obtained by viewing the thermoreversible recording medium from the side of the transparent protective layer 14 as indicated by "E" when under illumination from the side of the transparent protective layer 14 as indicated by "L".

Embodiment 9

Figure 5:
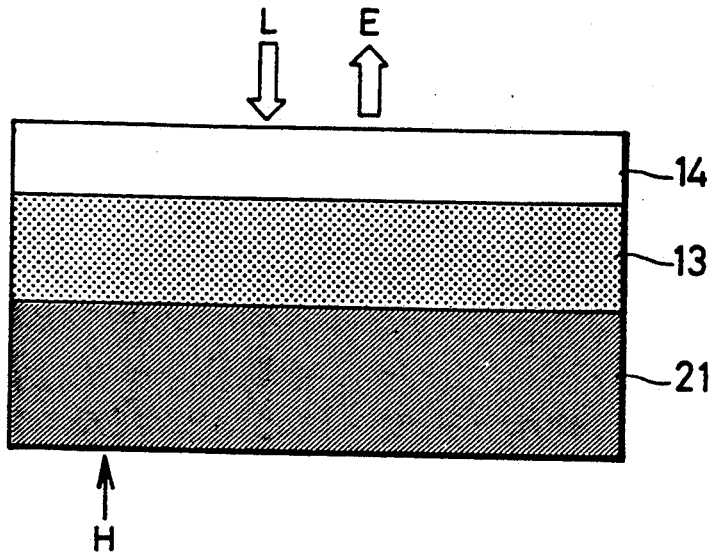
FIG. 5 is a sectional view showing the structure of a thermoreversible recording medium according to Embodiment 9.

FIG. 5 is a sectional view showing the structure of a thermoreversible recording medium according to Embodiment 9 of this invention.

A substrate 21 of this embodiment is made of an inorganic fiber paper of good thermal conductivity, ceramic sheet or metal sheet, or plastic sheet in which is dispersed carbon black or metal powder. A thermoreversible recording/display layer 13 is formed over and adjacent to this substrate 21, and a transparent protective layer 14 is formed over and adjacent to the thermoreversible recording/display layer 13.

The substrate 21 according to Embodiment 9 is made of material that has a property of reflecting or absorbing light, so that the substrate 21 serves also as a reflecting-/absorbing layer, and there is no need for a separate reflecting/absorbing layer.

The materials used to form the thermoreversible recording/display layer 13 and transparent protective layer 14 may be the same materials used in the thermoreversible recording/display layer and transparent protective layer of the thermoreversible recording medium according to Embodiment 7 (FIG. 3) and Embodiment 8 (FIG. 4).

If recording to a thermoreversible recording medium according to Embodiment 9 is performed by heating by means of a thermal head from the side of substrate 21 as indicated by "H", heat will be efficiently transmitted to thermoreversible recording/display layer 13.

Visible information may be obtained by viewing the thermoreversible recording medium from the side of the transparent protective layer 14 as indicated by "E" when under illumination from the side of the transparent protective layer 14 as indicated by "L".

Embodiment 10

Figure 6:
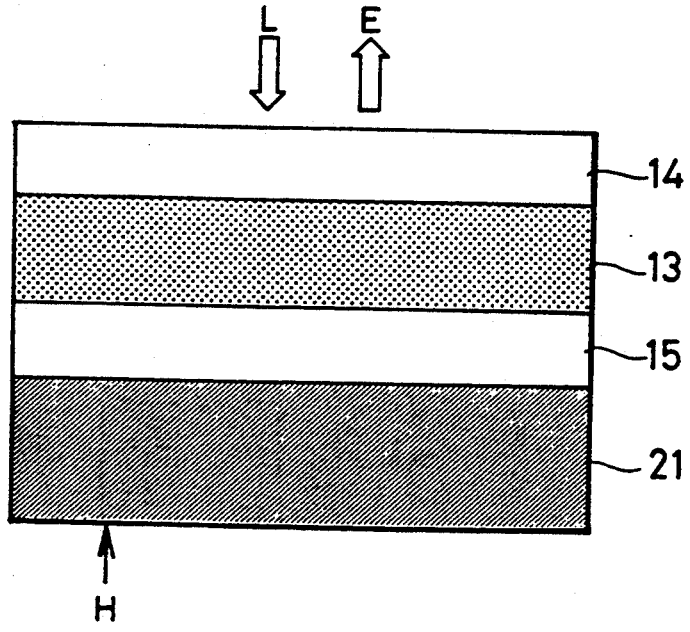
FIG. 6 is a sectional view showing the structure of a thermoreversible recording medium according to Embodiment 10.

FIG. 6 is a sectional view showing the structure of a thermoreversible recording medium according to Embodiment 10 of this invention.

The layer structure of the thermoreversible recording medium according to Embodiment 10 is identical to the layer structure of the thermoreversible recording medium according to Embodiment 9 (FIG. 5), except that an enhancing layer 15 is formed between substrate 21 and thermoreversible recording/display layer 13. Enhancing layer 15 is provided to heighten the contrast between the transparent and opaque portions.

The material of enhancing layer 15 may be identical with the material used in the enhancing layer of the thermoreversible recording medium according to Embodiment 8 (FIG. 4).

It is possible to add information by handwriting with water-based or oil-based felt-tip pen or the like on the transparent protective layer 14.

If recording to a thermoreversible recording medium according to Embodiment 10 is performed by heating by means of a thermal head from the side of substrate 21 as indicated by "H", heat will be efficiently transmitted to thermoreversible recording/display layer 13.

Visible information may be obtained by viewing the thermoreversible recording medium from the side of the transparent protective layer 14 as indicated by "E"

when under illumination from the side of the transparent protective layer 14 as indicated by "L".

Embodiment 11

Figure 7:
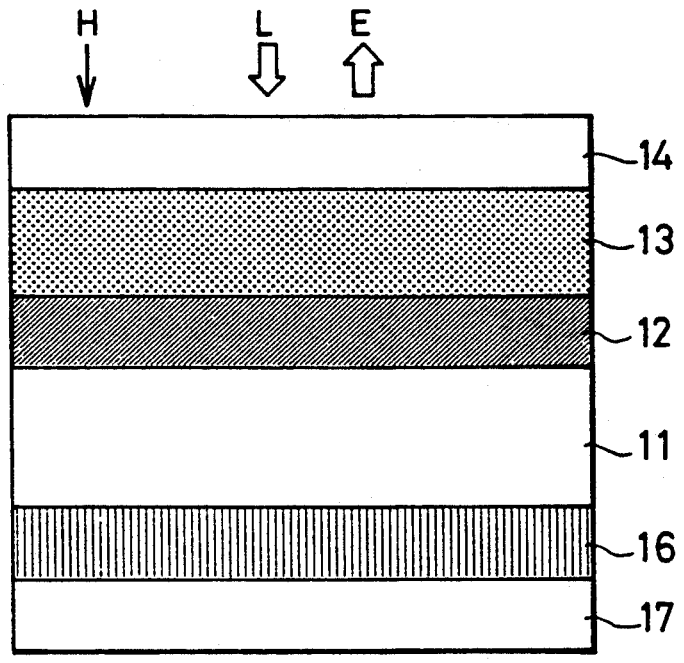
FIG. 7 is a sectional view showing the structure of a thermoreversible recording medium according to Embodiment 11.

FIG. 7 is a sectional view showing the structure of a thermoreversible recording medium according to Embodiment 11 of this invention.

The thermoreversible recording medium of Embodiment 11 is capable of compound recording, i.e., recording encoded information, in addition to thermoreversible recording, which is directly visible.

The layer structure of the thermoreversible recording medium according to Embodiment 11 is identical to the layer structure of the thermoreversible recording medium according to Embodiment 7 (FIG. 3), except that an encoded information recording layer 16 for the recording of encoded information is formed beneath and adjacent to the substrate 11 and a further protective layer 17 is formed beneath and adjacent to the encoded information recording layer 16.

The recording medium for the encoded information recording layer 16 may be a magnetic recording medium, optical recording medium, thermal recording medium, electrical recording medium such as IC memories used in IC cards, magneto-optical recording medium, thermomagnetic recording medium, or the like.

The material forming the protective layer 17 may be a plastic such as polyester, polyethylene, polypropylene, cellophane, polyvinyl chloride, polyolefin, polyvinyl alcohol, polyvinylidene chloride, polystyrene, polyamide, polycarbonate, polyacrylate, polysulfone, fluoride resin, polyacrylonitrile, polyethersulfone, polybutadiene, polyimide or UV-cured resin, or an inorganic material such as $SiO_2$, $Al_2O_3$ or $TiO_2$.

If recording to a thermoreversible recording medium according to Embodiment 11 is performed by heating by means of a thermal head from the side of the transparent protective layer 14 as indicated by "H", heat will be efficiently transmitted to thermoreversible recording/display layer 13.

Visible information may be obtained by viewing the thermoreversible recording medium from the side of the transparent protective layer 14 as indicated by "E" when under illumination from the side of the transparent protective layer 14 as indicated by "L".

In addition to this visual information, the thermoreversible recording medium according to Embodiment 11 can record encoded information as it is additionally provided with the encoded information recording layer 16.

Embodiment 12

Figure 8:
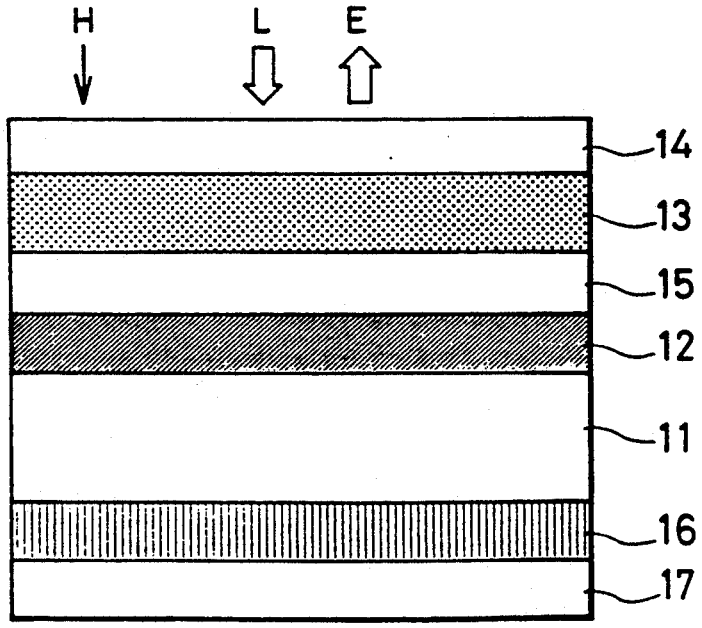
FIG. 8 is a sectional view showing the structure of a thermoreversible recording medium according to Embodiment 12.

FIG. 8 is a sectional view showing the structure of a thermoreversible recording medium according to Embodiment 12 of this invention.

The layer structure of the thermoreversible recording medium according to Embodiment 12 is identical to the layer structure of the thermoreversible recording medium according to Embodiment 11 (FIG. 9) above described, except that an enhancing layer 15 is formed between reflecting/absorbing layer 12 and thermoreversible recording/display layer 13.

If recording to a thermoreversible recording medium according to this Embodiment is performed by heating by means of a thermal head from the side of the transparent protective layer 14 as indicated by "H", heat will be efficiently transmitted to thermoreversible recording/display layer 13.

Visible information may be obtained by viewing the thermoreversible recording medium from the side of the transparent protective layer 14 as indicated by "E" when under illumination from the side of the transparent protective layer 14 as indicated by "L".

In addition to this visual information, the thermoreversible recording medium according to Embodiment 12 can record encoded information as it is additionally provided with the encoded information recording layer 16.

Embodiment 13

Figure 9:
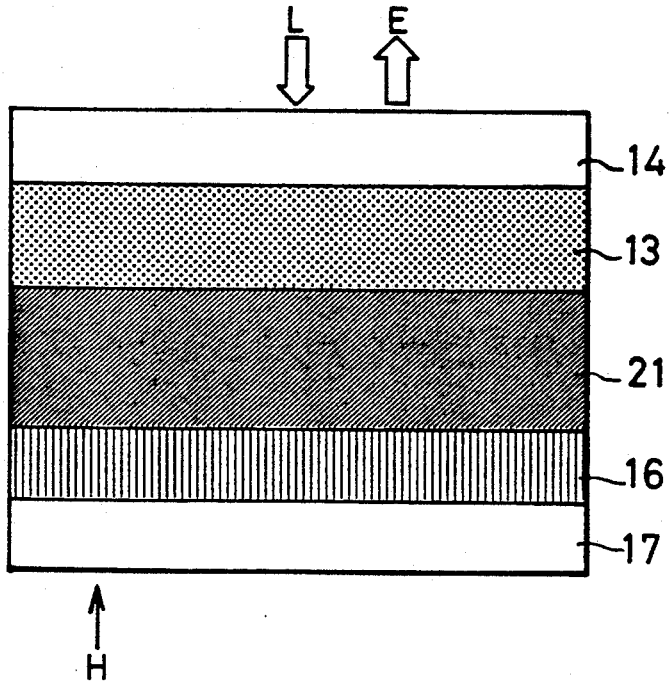
FIG. 9 is a sectional view showing the structure of a thermoreversible recording medium according to Embodiment 13.

FIG. 9 is a sectional view showing the structure of a thermoreversible recording medium according to Embodiment 13 of this invention.

The thermoreversible recording medium of Embodiment 13 is capable of recording encoded information in addition to thermoreversible recording.

The layer structure of the thermoreversible recording medium according to Embodiment 13 is identical to the layer structure of the thermoreversible recording medium according to Embodiment 9 (FIG. 5) above described, except that an encoded information recording layer 16 for the recording of encoded information is formed beneath and adjacent to the substrate 21, and a further protective layer 17 is formed beneath and adjacent to the encoded information recording layer 16.

It is possible to add information by handwriting with water-based or oil-based felt-tip pen or the like on the transparent protective layer 14.

Recording on the thermoreversible recording medium according to Embodiment 13 can also be performed by thermal printing using thermal heads on the side of protective layer 17, which is on the side opposite to transparent protective layer 14.

Visible information may be obtained by viewing the thermoreversible recording medium from the side of the transparent protective layer 14 as indicated by "E" when under illumination from the side of the transparent protective layer 14 as indicated by "L".

In addition to this visual information, the thermoreversible recording medium according to Embodiment 13 can record encoded information as it is additionally provided with the encoded information recording layer 16.

Embodiment 14

Figure 10:
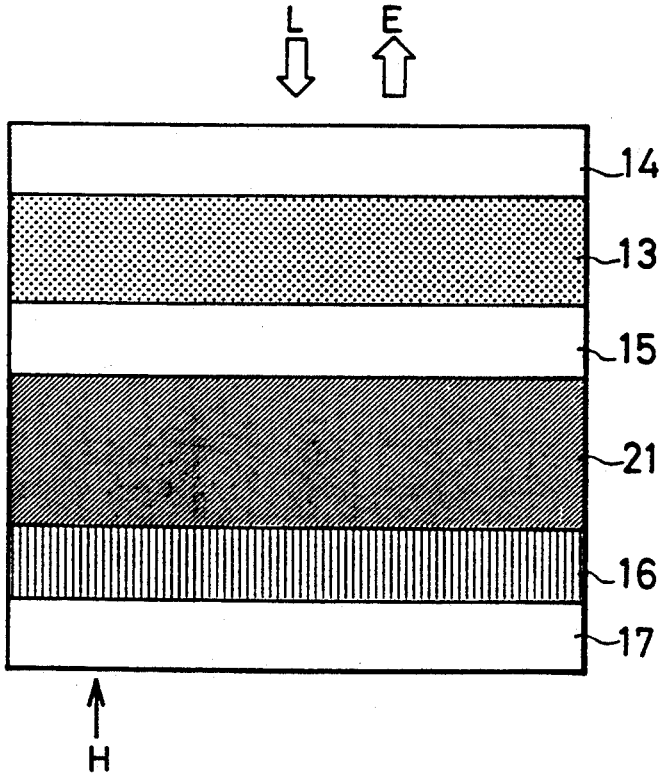
FIG. 10 is a sectional view showing the structure of a thermoreversible recording medium according to Embodiment 14.

FIG. 10 is a sectional view showing the structure of a thermoreversible recording medium according to Embodiment 14 of this invention.

The layer structure of the thermoreversible recording medium according to Embodiment 14 is identical to the layer structure of the thermoreversible recording medium according to Embodiment 13 (FIG. 9), except that an enhancing layer 15 is formed between substrate 21 and thermoreversible recording/display layer 13.

Further, the recording medium of recording layer 16 is as shown in Embodiment 11 above described.

It is possible to add information by handwriting with water-based or oil-based felt-tip pen or the like on the transparent protective layer 14.

Recording on the thermoreversible recording medium according to Embodiment 14 can also be performed by thermal printing using thermal heads on the side of protective layer 17, which is on the side opposite to transparent protective layer 14.

Visible information may be obtained by viewing the thermoreversible recording medium from the side of the transparent protective layer 14 as indicated by "E" when under illumination from the side of the transparent protective layer 14 as indicated by "L".

In addition to this visual information, the thermoreversible recording medium according to Embodiment 14 can record encoded information as it is additionally provided with the encoded information recording layer 16.

Embodiment 15

Figure 11:
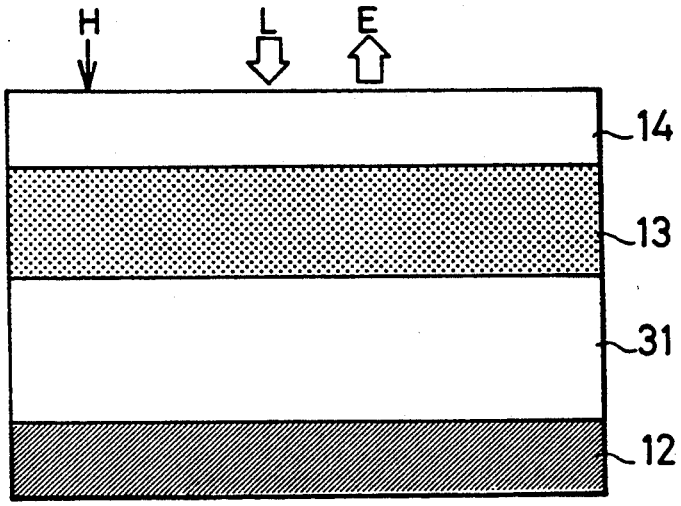
FIG. 11 is a sectional view showing the structure of a thermoreversible recording medium according to Embodiment 15.

FIG. 11 is a sectional view showing the structure of a thermoreversible recording medium according to Embodiment 15 of this invention.

In the thermoreversible recording medium according to Embodiment 15, a thermoreversible recording/display layer 13 is formed over and adjacent to a transparent substrate 31, a transparent protective layer 14 is further formed over and adjacent to the thermoreversible recording/display layer 13, and a reflecting/absorbing layer 12 is formed beneath and adjacent to the transparent substrate 31. The thickness of the transparent substrate 31 should be sufficient to maintain the thermoreversible recording/display layer 13, and is preferably 25 μm to 1 mm. Thus, the transparent substrate 31 serves to support the thermoreversible recording/display layer 13. Moreover, the transparent substrate 31 is positioned between the thermoreversible recording/display layer 13 and the reflecting/absorbing layer 12, and serves also as an enhancing layer for heightening the contrast between the transparent portions and the opaque portions of thermoreversible recording/display layer 13.

The material of the transparent substrate 31 may be a transparent plastic, such as polyester, polyethylene, polypropylene, cellophane, polyvinyl chloride, polyolefin, polyvinyl alcohol, polyvinylidene chloride, polystyrene, polyamide, polycarbonate, polyacrylate, polysulfone, fluoride resin, polyacrylonitrile, polyethersulfone or polybutadiene.

The materials of other layers, namely reflecting/absorbing layer 12, thermoreversible recording/display layer 13 and transparent protective layer 14, may be identical to those of Embodiment 7.

If recording to a thermoreversible recording medium according to this Embodiment is performed by heating by means of a thermal head from the side of the transparent protective layer 14 as indicated by "H", heat will be efficiently transmitted to thermoreversible recording/display layer 13.

Visible information may be obtained by viewing the thermoreversible recording medium from the side of the transparent protective layer 14 as indicated by "E" when under illumination from the side of the transparent protective layer 14 as indicated by "L".

Embodiment 16

Figure 12:
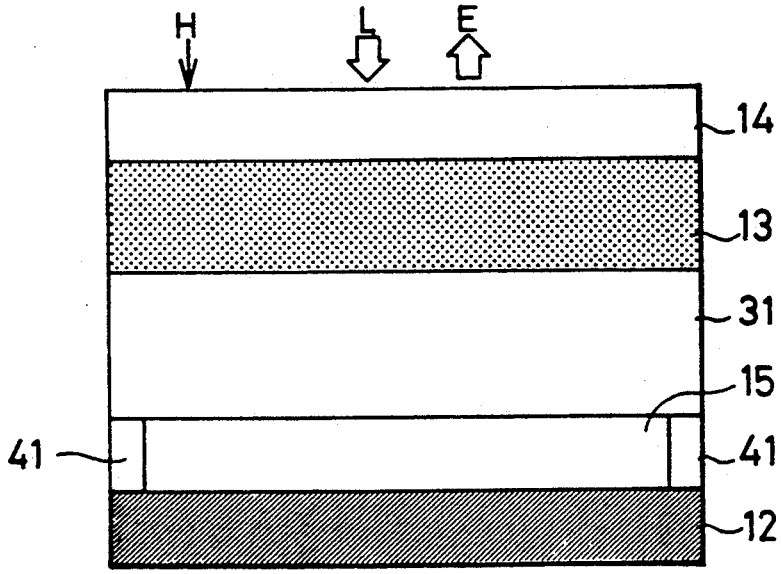
FIG. 12 is a sectional view showing the structure of a thermoreversible recording medium according to Embodiment 16.

FIG. 12 is a sectional view showing the structure of a thermoreversible recording medium according to Embodiment 16 of this invention.

The layer structure of the thermoreversible recording medium according to Embodiment 16 is identical to the layer structure of the thermoreversible recording medium according to Embodiment 15 (FIG. 11), except that a spacing layer (made of an adhesive layer) 41 is provided between the transparent substrate 31 and the reflecting/absorbing layer 12. The spacing layer 41 is formed between peripheral portions of the transparent substrate 31 and the reflecting/absorbing layer 12 to form an air space by which the portions other than the peripheral portions of the transparent substrate 31 and the reflecting/absorbing layer 12 are separated from each other, and the air space, denoted by 15, formed between the transparent substrate 31 and the reflecting/absorbing layer 12 serves as an enhancing layer to heighten the contrast between the transparent and opaque portions of the thermoreversible recording/display layer 13.

If recording to a thermoreversible recording medium according to this Embodiment is performed by heating by means of a thermal head from the side of the transparent protective layer 14 as indicated by "H", heat will be efficiently transmitted to thermoreversible recording/display layer 13.

Visible information may be obtained by viewing the thermoreversible recording medium from the side of the transparent protective layer 14 as indicated by "E" when under illumination from the side of the transparent protective layer 14 as indicated by "L".

Embodiment 17

Figure 13:
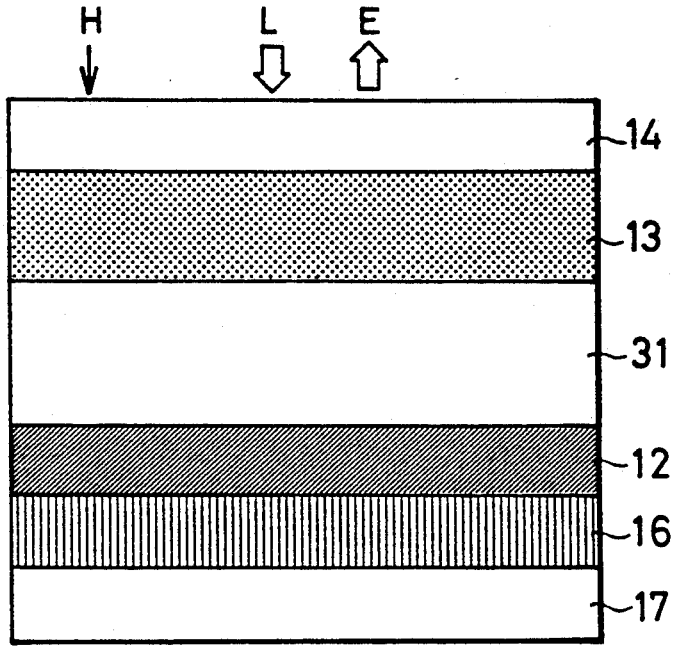
FIG. 13 is a sectional view showing the structure of a thermoreversible recording medium according to Embodiment 17.

FIG. 13 is a sectional view showing the structure of a thermoreversible recording medium according to Embodiment 17 of this invention.

The thermoreversible recording medium of Embodiment 17 is capable of recording encoded information in addition to thermoreversible recording.

The layer structure of the thermoreversible recording medium according to Embodiment 17 is identical to the layer structure of the thermoreversible recording medium according to Embodiment 15 (FIG. 11), except that an encoded information recording layer 16 for the recording of encoded information is formed beneath and adjacent to the reflecting/absorbing layer 12, and a further protective layer 17 is formed beneath and adjacent to the encoded information recording layer 16.

The recording medium of encoded information recording layer 16 is as described in connection with Embodiment 11 (FIG. 7).

If recording to a thermoreversible recording medium according to this Embodiment is performed by heating by means of a thermal head from the side of the transparent protective layer 14 as indicated by "H", heat will be efficiently transmitted to thermoreversible recording/display layer 13.

Visible information may be obtained by viewing the thermoreversible recording medium from the side of the transparent protective layer 14 as indicated by "E" when under illumination from the side of the transparent protective layer 14 as indicated by "L".

In addition to this visual information, the thermoreversible recording medium according to Embodiment 17 can record encoded information as it is additionally provided with the encoded information recording layer 16.

Embodiment 18

Figure 14:
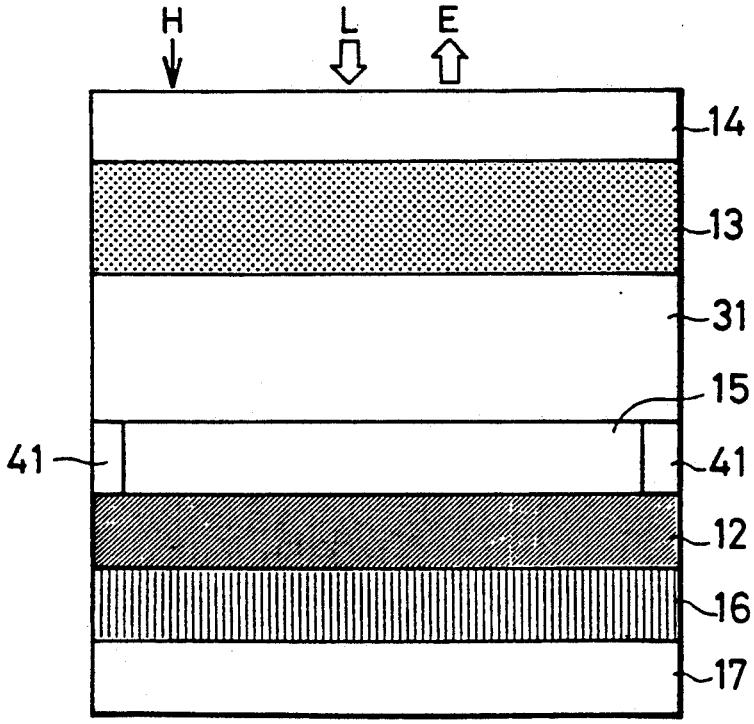
FIG. 14 is a sectional view showing the structure of a thermoreversible recording medium according to Embodiment 18.

FIG. 14 is a sectional view showing the structure of a thermoreversible recording medium according to Embodiment 18 of this invention.

The layer structure of the thermoreversible recording medium according to Embodiment 18 is identical to the layer structure of the thermoreversible recording medium according to Embodiment 17 (FIG. 13), except that a spacing layer (made of an adhesive layer) 41 is provided between the transparent substrate 31 and the reflecting/absorbing layer 12. The spacing layer 41 is formed between peripheral portions of the transparent substrate 31 and the reflecting/absorbing layer 12 to form an air space by which the portions other than the peripheral portions of the transparent substrate 31 and the reflecting/absorbing layer 12 are separated from each other, and the air space, denoted by 15, formed between the transparent substrate 31 and the reflecting-/absorbing layer 12 serves as an enhancing layer to heighten the contrast between the transparent and opaque portions of the thermoreversible recording/display layer 13.

If recording to a thermoreversible recording medium according to this Embodiment is performed by heating by means of a thermal head from the side of the transparent protective layer 14 as indicated by "H", heat will be efficiently transmitted to thermoreversible recording/display layer 13.

Visible information may be obtained by viewing the thermoreversible recording medium from the side of the transparent protective layer 14 as indicated by "E" when under illumination from the side of the transparent protective layer 14 as indicated by "L".

In addition to this visual information, the thermoreversible recording medium according to Embodiment 18 can record encoded information as it is additionally provided with the encoded information recording layer 16.

Embodiment 19

Figure 15:
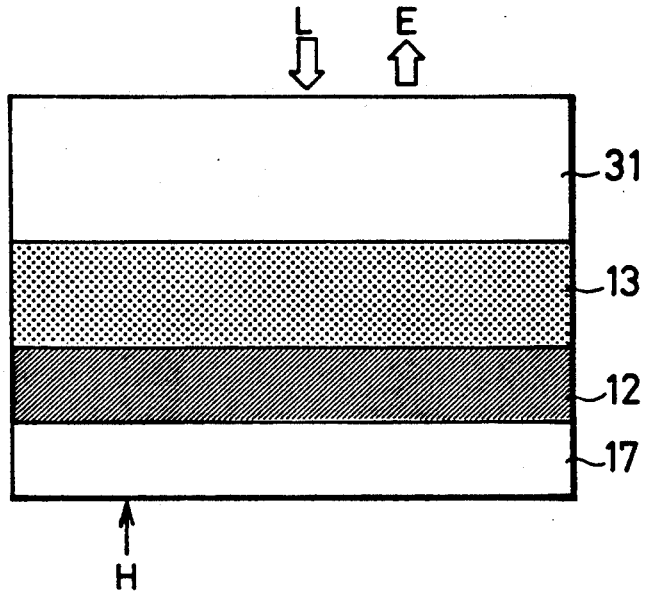
FIG. 15 is a sectional view showing the structure of a thermoreversible recording medium according to Embodiment 19.

FIG. 15 is a sectional view showing the structure of a thermoreversible recording medium according to Embodiment 19 of this invention.

The thermoreversible recording medium according to Embodiment 19 comprises a transparent substrate 31 made of transparent plastic of a thickness of 100 μm, and a thermoreversible recording/display layer 13 of a thickness of 20 μm and formed beneath and adjacent to the lower surface of the transparent substrate 31. A reflecting/absorbing layer 12 is formed beneath and adjacent to the transparent substrate 31. The reflecting-/absorbing layer 12 is printed in black, so that it serves as a light-absorbing layer. A protective layer 17 made of plastic sheet of a thickness of 5 μm is formed to cover the lower surface of the reflecting/absorbing layer 12.

The material for the transparent substrate 31 is as described in connection with the Embodiment 15 (FIG. 11).

The thickness of the transparent substrate 31 is may be such as to support the thermoreversible recording-/display layer 13, and is preferably 25 μm to 1 mm.

It is also possible, if required, to print characters or graphics on the peripheral portion of transparent substrate 31, corresponding to the peripheral portion of the thermoreversible recording/display layer 13 where normally no thermal recording is made. It is thus possible, by the use of normal printing in addition to thermally printed recording, to record information that need not be altered or erased.

The thickness of transparent protective layer 17 should be such as to permit the transmission of heat from the heat generating recording element through transparent protective layer 17 to thermoreversible recording/display layer 13, and is preferably 1-15 μm.

If recording to a thermoreversible recording medium according to this Embodiment is performed by heating by means of a thermal head from the side of protective layer 17 as indicated by "H", heat will be efficiently transmitted to thermoreversible recording/display layer 13.

Visible information may be obtained by viewing the thermoreversible recording medium from the side of the transparent substrate 31 as indicated by "E" when under illumination from the side of the transparent substrate 31 as indicated by "L".

Embodiment 20

Figure 16:
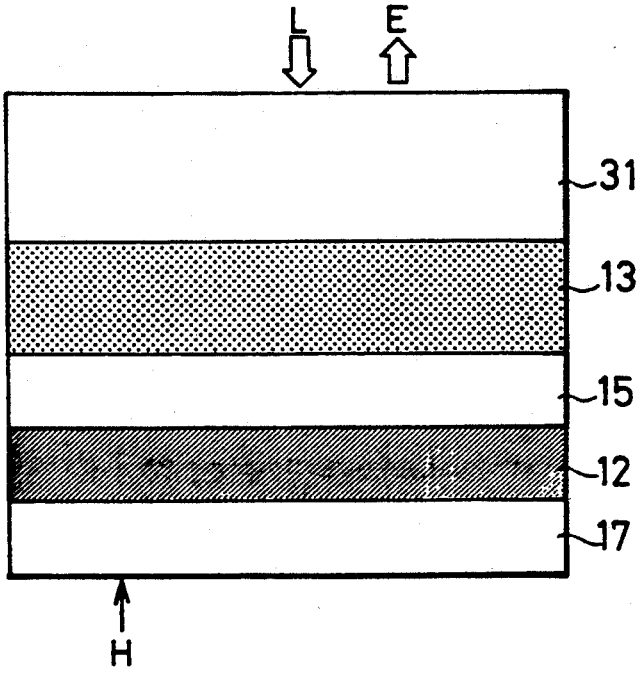
FIG. 16 is a sectional view showing the structure of a thermoreversible recording medium according to Embodiment 20.

FIG. 16 is a sectional view showing the structure of a thermoreversible recording medium according to Embodiment 20 of this invention.

The layer structure of the thermoreversible recording medium according to Embodiment 20 is identical to the layer structure of the thermoreversible recording medium according to Embodiment 19 (FIG. 15), except that an enhancing layer 15 is formed between thermoreversible recording/display layer 13 and reflecting-/absorbing layer 12.

Enhancing layer 15 is provided to heighten the contrast between the transparent portions and the opaque portions.

The material of enhancing layer 15 may be identical with the material described in connection with Embodiment 8 (FIG. 8).

If recording to a thermoreversible recording medium according to this Embodiment is performed by heating by means of a thermal head from the side of protective layer 17 as indicated by "H", heat will be efficiently transmitted to thermoreversible recording/display layer 13.

Visible information may be obtained by viewing the thermoreversible recording medium from the side of the transparent substrate 31 as indicated by "E" when under illumination from the side of the transparent substrate 31 as indicated by "L".

Embodiment 21

Figure 17:
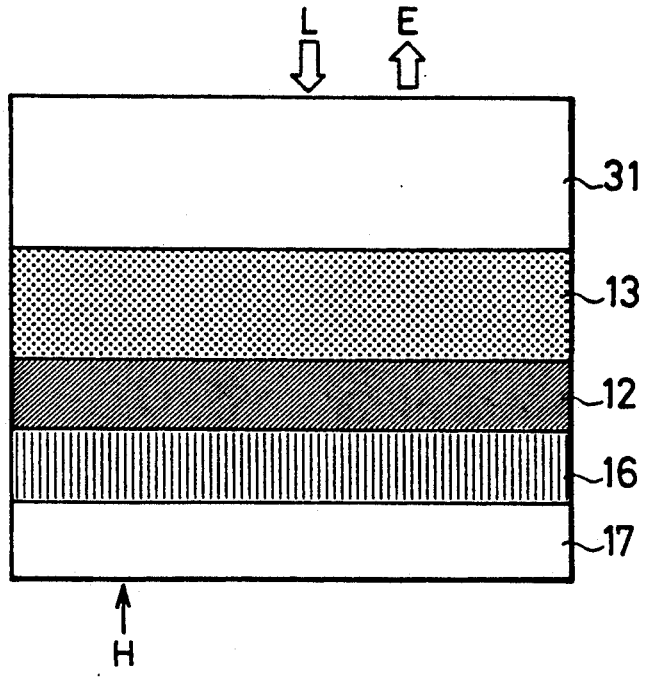
FIG. 17 is a sectional view showing the structure of a thermoreversible recording medium according to Embodiment 21.

FIG. 17 is a sectional view showing the structure of a thermoreversible recording medium according to Embodiment 21 of this invention.

The thermoreversible recording medium of Embodiment 21 is capable of recording encoded information in addition to thermoreversible recording.

The layer structure of the thermoreversible recording medium according to Embodiment 21 is identical to the layer structure of the thermoreversible recording medium according to Embodiment 19 (FIG. 15), except that an encoded information recording layer 16 for the recording of encoded information is formed between reflecting/absorbing layer 12 and protective layer 17.

The recording medium for the encoded information recording layer 16 is as described in connection with Embodiment 11 (FIG. 7).

The materials forming the respective layers other than the recording layer 16 may be identical to those of Embodiment 19 (FIG. 15).

If recording to a thermoreversible recording medium according to this Embodiment is performed by heating by means of a thermal head from the side of protective layer 17 as indicated by "H", heat will be efficiently transmitted to thermoreversible recording/display layer 13.

Visible information may be obtained by viewing the thermoreversible recording medium from the side of the transparent substrate 31 as indicated by "E" when under illumination from the side of the transparent substrate 31 as indicated by "L".

In addition to this visual information, the thermoreversible recording medium according to Embodiment 21 can record encoded information as it is additionally provided with the encoded information recording layer 16.

Embodiment 22

Figure 18:
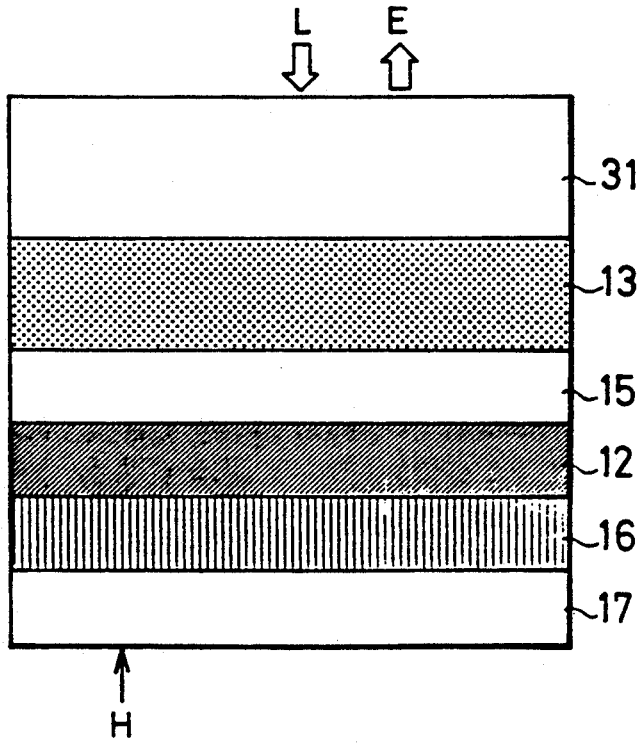
FIG. 18 is a sectional view showing the structure of a thermoreversible recording medium according to Embodiment 22.

FIG. 18 is a sectional view showing the structure of a thermoreversible recording medium according to Embodiment 22 of this invention.

The thermoreversible recording medium of Embodiment 22 is capable of recording encoded information in addition to thermoreversible recording.

The layer structure of the thermoreversible recording medium according to Embodiment 22 is identical to the layer structure of the thermoreversible recording medium according to Embodiment 20 (FIG. 16), except that a recording layer 16 for the recording of encoded information is formed between reflecting/absorbing layer 12 and protective layer 17.

The materials forming the respective layers other than the recording layer 16 may be identical to those of Embodiment 20.

The recording medium of the recording layer 16 may be any of those described in connection with Embodiment 21 (FIG. 17).

If recording to a thermoreversible recording medium according to this Embodiment is performed by heating by means of a thermal head from the side of protective layer 17 as indicated by "H", heat will be efficiently transmitted to thermoreversible recording/display layer 13.

Visible information may be obtained by viewing the thermoreversible recording medium from the side of the transparent substrate 31 as indicated by "E" when under illumination from the side of the transparent substrate 31 as indicated by "L".

In addition to this visual information, the thermoreversible recording medium according to this Embodiment can record encoded information as it is additionally provided with the encoded information recording layer 16.

Embodiment 23

Figure 19:
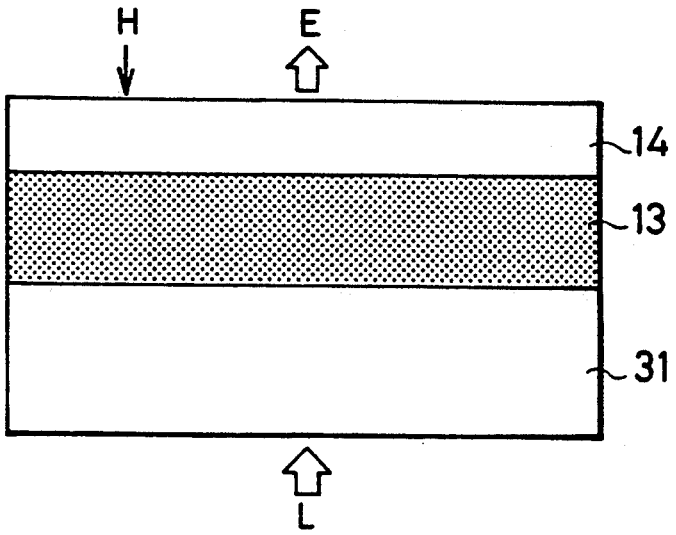
FIG. 19 is a sectional view showing the structure of a thermoreversible recording medium according to Embodiment 23.

FIG. 19 is a sectional view showing the structure of a thermoreversible recording medium according to Embodiment 23 of this invention.

This thermoreversible recording medium comprises a transparent substrate 31 made of polyester sheet of a thickness of 100 μm, and a thermoreversible recording-/display layer 13 of a thickness of 20 μm and to cover the transparent substrate 31. A transparent protective layer 14 made of polyester sheet of a thickness of 5 μm is formed over and adjacent to the thermoreversible recording/display layer 13.

In place of polyester used as the transparent substrate 31 in Embodiment 23, other examples described in connection with Embodiment 15 can be used. The thickness of the transparent substrate 31 should be such as to maintain the thermoreversible recording/display layer 13 and is preferably 25 μm to 1 mm.

The material for the thermoreversible recording/display layer 13 and the transparent protective layer 14 may be those described in connection with Embodiment 7.

The thickness of transparent protective layer 14 should be such as to permit the transmission of heat from the heat generating recording element through transparent protective layer 14 to thermoreversible recording/display layer 13, and is preferably 1–15 μm.

It is also possible, if required, to print characters or graphics on the peripheral portion of transparent protective layer 14, corresponding to the peripheral portion of the thermoreversible recording/display layer 13 where normally no thermal recording is made. It is thus possible, by the use of normal printing in addition to thermally printed recording, to record information that need not be altered or erased.

If recording to a thermoreversible recording medium according to this Embodiment is performed by heating by means of a thermal head from the side of the transparent protective layer 14 as indicated by "H", heat will be efficiently transmitted to thermoreversible recording/display layer 13.

Visible information may be obtained by viewing the thermoreversible recording medium from the side of the transparent substrate 31 as indicated by "E" when under illumination from the side of the transparent substrate 31 as indicated by "L".

The thermoreversible recording medium of this embodiment may be used in a projector such as an overhead projector.

Embodiment 24

Figure 20:
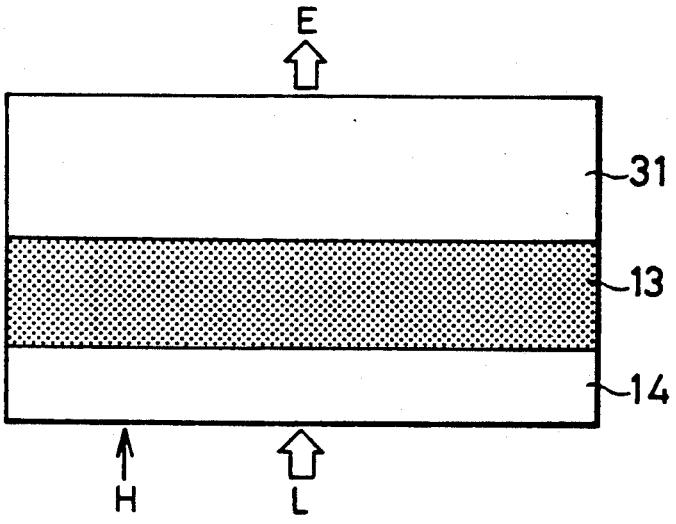
FIG. 20 is a sectional view showing the structure of a thermoreversible recording medium according to Embodiment 24.

FIG. 20 is a sectional view showing the structure of a thermoreversible recording medium according to Embodiment 24 of this invention.

The layer structure of the thermoreversible recording medium according to Embodiment 24 is identical to the layer structure of the thermoreversible recording medium according to Embodiment 23 (FIG. 19), except that the order of the layers are reversed. That is, in the thermoreversible recording recording medium according to Embodiment 24, as shown in FIG. 20, a thermoreversible recording/display layer 13 is formed beneath adjacent to a transparent substrate 31, and a transparent protective layer 14 is formed beneath and adjacent to the thermoreversible recording/display layer 13. The materials of the transparent protective layer 31, the thermoreversible recording/display layer 13 and the transparent protective layer 14 may be identical to those described in connection with Embodiment 23.

If recording to a thermoreversible recording medium according to this Embodiment is performed by heating by means of a thermal head from the side of the transparent protective layer 14 as indicated by "H", heat will be efficiently transmitted to thermoreversible recording/display layer 13.

Visible information may be obtained by viewing the thermoreversible recording medium from the side of the transparent substrate 31 as indicated by "E" when under illumination from the side of the transparent substrate 31 as indicated by "L".

The thermoreversible recording medium of this embodiment may also be used in a projector such as an overhead projector.

It is possible to add information by handwriting with water-based or oil-based felt-tip pen or the like on the transparent substrate 31. Such handwritten information may be deleted using alcohol, water, or other solvent.

It is also possible, if required, to print characters or graphics on the peripheral portion of transparent substrate 31, corresponding to the peripheral portion of the thermoreversible recording/display layer 13 where normally no thermal recording is made. It is thus possible, by the use of normal printing in addition to thermally printed recording, to record information that need not be altered or erased.

Embodiment 25

Figure 21:
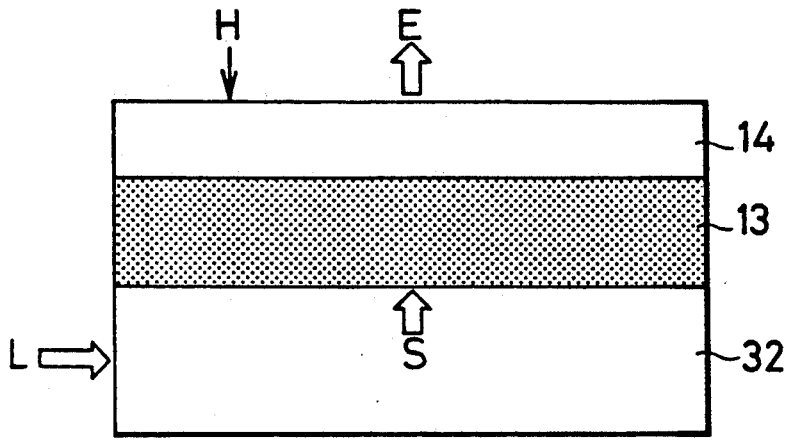
FIG. 21 is a sectional view showing the structure of a thermoreversible recording medium according to Embodiment 25.

FIG. 21 is a sectional view showing the structure of a thermoreversible recording medium according to Embodiment 25 of this invention.

The layer structure of the thermoreversible recording medium according to Embodiment 25 is identical to the layer structure of the thermoreversible recording medium according to Embodiment 23 (FIG. 19), except that the transparent substrate 31 is replaced by a planar light source 32.

The planar light source 32 used was of the edge-lighted type which comprises a panel at one edge of which light is made incident, and throughout one principal surface (upper surface in FIG. 21) of which light is emitted. The planar light source 32 used in Embodiment 25 receives environmental light at one edge, and performs reflection and diffusion with a high efficiency, and emits light from one surface, with the direction of light emission being normal to the path of incident light. An acrylic resin panel, ACRYLITE (tradename, made by Mitsubishi Rayon Kabushiki Kaisha), can be used as the planar light source 32.

If recording to a thermoreversible recording medium according to this Embodiment is performed by heating by means of a thermal head from the side of the transparent protective layer 14 as indicated by "H", heat will be efficiently transmitted to thermoreversible recording/display layer 13.

Visible information may be obtained by viewing the thermoreversible recording medium from the side of the transparent protective layer 14 as indicated by "E" when light is introduced at one edge of the planar light source 32 as indicated by "L", and light is emitted from one of its surfaces facing the thermoreversible recording/display layer 13 as indicated by "S".

Embodiment 26

Figure 22:
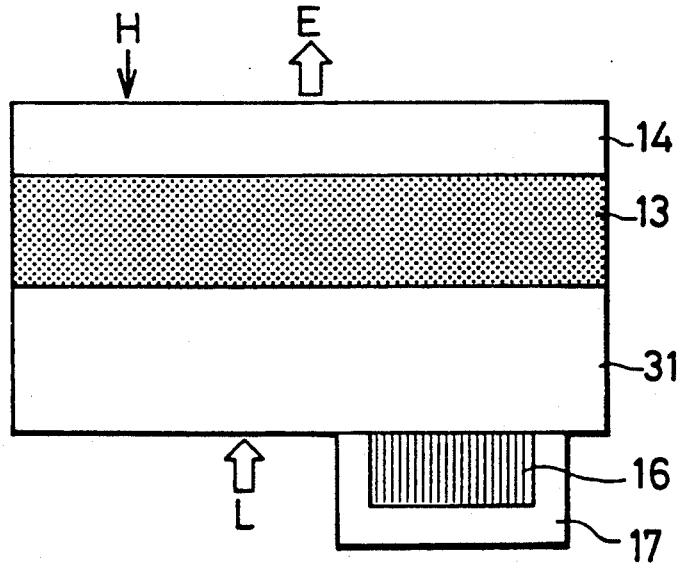
FIG. 22 is a sectional view showing the structure of a thermoreversible recording medium according to Embodiment 26.

FIG. 22 is a sectional view showing the structure of a thermoreversible recording medium according to Embodiment 26 of this invention.

The layer structure of the thermoreversible recording medium according to Embodiment 26 is identical to the layer structure of the thermoreversible recording medium according to Embodiment 23 (FIG. 19), except that a recording layer 16 for the recording of encoded information is formed beneath and adjacent to a portion of the transparent substrate 31, and a protective layer 17 is formed beneath and adjacent to the recording layer 16.

The recording medium of the recording layer 16 may be any of those described in connection with Embodiment 11 (FIG. 7).

The material of the protective layer 17 may be any of those described in connection with the protective layer of Embodiment 11 (FIG. 7).

If recording to a thermoreversible recording medium according to this Embodiment is performed by heating by means of a thermal head from the side of the transparent protective layer 14 as indicated by "H", heat will be efficiently transmitted to thermoreversible recording/display layer 13.

Visible information may be obtained by viewing the thermoreversible recording medium from the side of the transparent protective layer 14 as indicated by "E" when under illumination from the side of the transparent substrate 31 as indicated by "L".

In addition to this visual information, the thermoreversible recording medium according to Embodiment 26 can record encoded information as it is additionally provided with the encoded information recording layer 16.

The recording layer 16 and the protective layer 17 extend over part only of the entire area over which the thermoreversible recording/display layer 13 extends. This configuration is used where the relatively small area is needed for the recording of the encoded information. Where the recording layer 16 and the protective layer 17 are transparent, the thermoreversible recording can be made throughout the entire area of the thermoreversible recording/display layer 13. Where the recording layer 16 and the protective layer 17 are not transparent, the thermoreversible recording cannot be made in the area covered by the recording layer 16 and the protective layer 17. But as they extend part only of the entire area of the thermoreversible recording/display layer 13, it can be ensured that the thermoreversible recording/display layer 13 still has enough area for the intended application.

Embodiment 27

Figure 23:
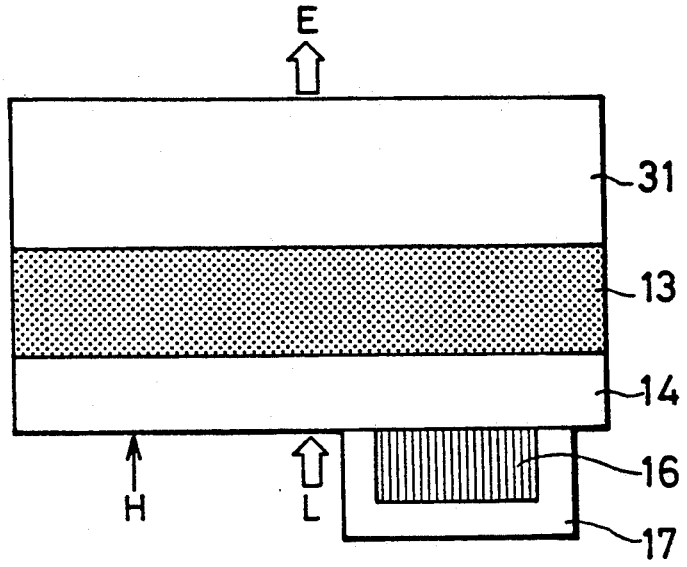
FIG. 23 is a sectional view showing the structure of a thermoreversible recording medium according to Embodiment 27.

FIG. 23 is a sectional view showing the structure of a thermoreversible recording medium according to Embodiment 27 of this invention.

The thermoreversible recording medium of Embodiment 27 is capable of recording encoded information in addition to thermoreversible recording.

The layer structure of the thermoreversible recording medium according to Embodiment 27 is identical to the layer structure of the thermoreversible recording medium according to Embodiment 24 (FIG. 20), except that a recording layer 16 for the recording of encoded information is formed beneath and adjacent to a portion of the transparent protective layer 14, and a protective layer 17 is formed beneath and adjacent to the recording layer 16. The transparent substrate 31, the thermoreversible recording/display layer 13 and the transparent protective layer 14 are identical to those of Embodiment 24.

The materials of the recording layer 16 and the protective layer 17 may be any of those described in connection with Embodiment 11 (FIG. 7).

If recording to a thermoreversible recording medium according to this Embodiment is performed by heating by means of a thermal head from the side of the transparent protective layer 14 as indicated by "H", heat will be efficiently transmitted to thermoreversible recording/display layer 13.

Visible information may be obtained by viewing the thermoreversible recording medium from the side of the transparent substrate 31 as indicated by "E" when under illumination from the side of the transparent substrate 31 as indicated by "L".

In addition to this visual information, the thermoreversible recording medium according to Embodiment 27 can record encoded information as it is additionally provided with the encoded information recording layer 16.

The thermoreversible recording medium of this embodiment may also be used in a projector such as an overhead projector.

Embodiment 28

Figure 24:
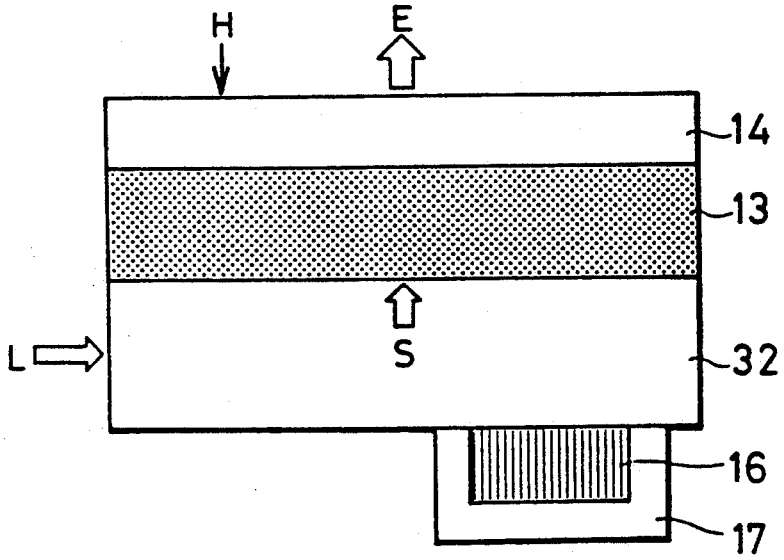
FIG. 24 is a sectional view showing the structure of a thermoreversible recording medium according to Embodiment 28.

FIG. 24 is a sectional view showing the structure of a thermoreversible recording medium according to Embodiment 28 of this invention.

The thermoreversible recording medium of Embodiment 28 is capable of recording encoded information in addition to thermoreversible recording.

The layer structure of the thermoreversible recording medium according to Embodiment 28 is identical to the layer structure of the thermoreversible recording medium according to Embodiment 25 (FIG. 21), except that a recording layer 16 for the recording of encoded information is formed beneath and adjacent to a portion of the planar light source 32, and a protective layer 17 is formed beneath and adjacent to the recording layer 16.

The planar light source 32, the thermoreversible recording/display layer 13 and the transparent protective layer 14 are identical to those of Embodiment 25 (FIG. 21).

The materials of the recording layer 16 and the protective layer 17 may be any of those described in connection with Embodiment 11 (FIG. 7).

If recording to a thermoreversible recording medium according to this Embodiment is performed by heating by means of a thermal head from the side of the transparent protective layer 14 as indicated by "H", heat will be efficiently transmitted to thermoreversible recording/display layer 13.

Visible information may be obtained by viewing the thermoreversible recording medium from the side of the transparent protective layer 14 as indicated by "E" when light is introduced at one edge of the planar light source 32 as indicated by "L", and light is emitted from one of its surfaces facing the thermoreversible recording/display layer 13 as indicated by "S".

In addition to this visual information, the thermoreversible recording medium according to Embodiment 28 can record encoded information as it is additionally provided with the encoded information recording layer 16.

Embodiments 29 to 32

Figure 25:
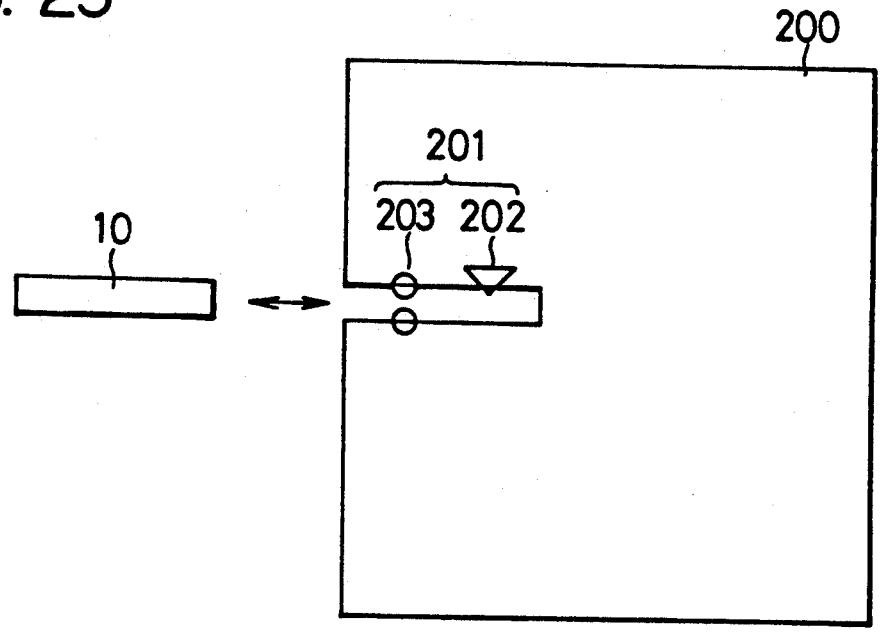
FIG. 25 is a schematic diagram illustrating an apparatus for recording in the thermoreversible recording medium according to this invention.
Figure 26:
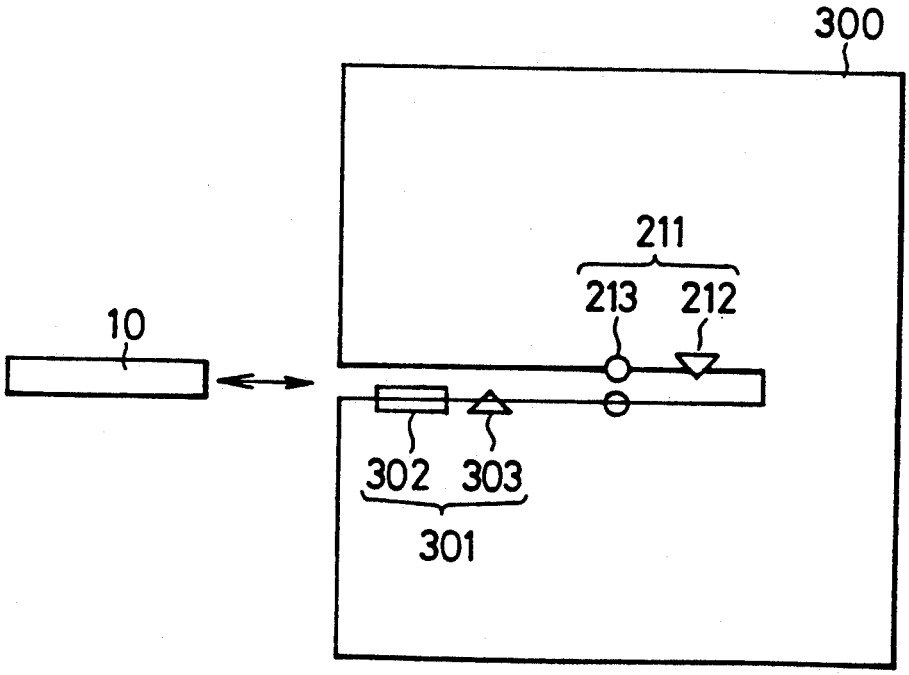
FIG. 26 is a schematic diagram illustrating an apparatus for recording in the thermoreversible recording medium according to this invention.

The recording methods for the thermoreversible recording media configured as above described will be described with reference to FIG. 25 and FIG. 26 as well as FIG. 1 and FIG. 2. FIG. 25 and FIG. 26 are schematic diagrams illustrating devices for recording in the thermoreversible recording medium according to this invention, and FIG. 1 and FIG. 2 are characteristic diagrams showing the light transmittance against temperature of thermoreversible recording materials according to this invention.

Embodiments 29 and 30 are implemented with the use of a data processing terminal or a recording device 200 shown in FIG. 25, while the Embodiments 31 and 32 are implemented with the use of a data processing terminal or a recording device 300 shown in FIG. 26. Embodiments 29 and 31 are implemented using the thermoreversible recording medium according to Embodiment 1 and having the transmittance characteristics shown in FIG. 1, while Embodiments 30 and 32 are implemented using the thermoreversible recording medium according to any of Embodiments 2 to 6 and having the transmittance characteristics shown in FIG. 2.

The recording device 200 shown in FIG. 25 includes a host computer storing information to be recorded, such as information representing "A", "B", "C", "D" and "E". The recording device 200 is also provided with a printing section 201 comprising a thermal head 202 for printing information, a heating roller 203 for erasing information and the like. The recording device 200 is not provided with means for recording or reading encoded information in or from the thermoreversible recording medium, so it is primarily intended for use in combination with the thermoreversible recording medium without an encoded information recording layer 16, i.e., the thermoreversible recording media, shown in FIG. 3, FIG. 4, FIG. 5, FIG. 6, FIG. 11, FIG. 12, FIG. 15, FIG. 16, FIG. 19, FIG. 20 and FIG. 21. But the recording device 200 can also be used in combination with the thermoreversible recording media with an encoded information recording layer.

The recording device 300 includes a host computer storing information to be recorded (e.g., numerals), and is further provided with a recording section having a reading head 302 for reading encoded information from the recording layer 16 of the thermoreversible recording medium 10, and a recording head 303 for recording encoded information, and a printing section 211 having a thermal head 212 for printing visual information and a heating roller 213 for erasing visual information.

The recording device 300 is suitable for use in combination with the thermoreversible recording media with an encoded information recording layer 16, i.e., the thermoreversible recording media shown in FIG. 7, FIG. 8, FIG. 9, FIG. 10, FIG. 13, FIG. 14, FIG. 17, FIG. 18, FIG. 22, FIG. 23 and FIG. 24.

With any of Embodiments 29 to 32, in the application of the thermoreversible recording media in which recording and observation are made from opposite sides of the medium, i.e., the thermoreversible recording media shown in FIG. 5, FIG. 6, FIG. 9, FIG. 10, FIG. 15, FIG. 16, FIG. 17, FIG. 18, FIG. 20 and FIG. 23, the images as written from the thermal head onto the thermoreversible recording/display layer, and the images as observed by the user onto the recording surface and the images as seen from the viewing surface are in mirror-image relationship, so it is necessary to adjust the host computer so that uninverted "A", "B", "C", "D" and "E" are seen on the viewing surface.

However, when the thermoreversible recording media are used in a projector such as an overhead projector, the image on the thermoreversible recording/display layer is projected onto a screen, and whether the image as written by the thermal head or the like need inversion or not depend also on the optical system used for the projection.

Embodiment 29

The procedure for use of the thermoreversible recording medium 10 made of a thermoreversible recording material according to Embodiment 1 and having transmittance characteristics illustrated in FIG. 1 in combination with the recording device 200 is as follows:

(1) First, the user inserts the thermoreversible recording medium 10 in the printing section 201 of the recording device 200.

(2) The recording device 200 senses the insertion of the thermoreversible recording medium 10 and sends a command to the printing section, instructing printing of the information to be recorded (e.g., "A", "B", "C", "D" and "E"). Responsive to the command, the printing section 201 starts printing on the thermoreversible recording/display layer 13 via the transparent protective layer 14, the protective layer 17 or the substrate 21, using the thermal head 202 and under the conditions of printing power of 0.1 w/dot, and printing time of 1 msec.

(3) The portions of "A", "B", "C", "D" and "E" printed on the thermoreversible recording/display layer 13 by means of the thermal head 202 are heated to 82° to 200° C., and cooled rapidly at a rate of 50° C./sec or more to room temperature, these portions are made transparent (state D in FIG. 1).

(4) After the printing, the user takes the thermoreversible recording medium 10 out of the recording device 200. Then, the thermoreversible recording medium 10 has the printed portions of "A", "B", "C", "D" and "E" fixed at the transparent state. The contrast, as represented by the ratio of transmittance (for light with wavelength of 550 nm) between the transparent state and the opaque state is 10, for example, and the user can visually discern the recorded information "A", "B", "C", "D" and "E", and this information is retained until the recording medium is used next.

(5) When the user again inserts the thermoreversible recording medium 10 in the recording device 200, for erasing the previous information and recording a different information on the thermoreversible recording medium 10, the thermoreversible recording medium 10 is heated by the heating roller 203 in the printing section 201 to a temperature range of 82° to 200° C. and is then cooled slowly at a rate of 50° C./sec. The thermoreversible recording/display layer 13 then becomes opaque (state A in FIG. 1), and the information previously recorded is erased.

Embodiment 30

The procedure for use of the thermoreversible recording medium 10 made of a thermoreversible recording material according to any of Embodiments 2 to 6 and having transmittance characteristics illustrated in FIG. 2 in combination with the recording device 200 is as follows:

(1) First, the user inserts the thermoreversible recording medium 10 in the printing section 201 of the recording device 200.

(2) The recording device 200 senses the insertion of the thermoreversible recording medium 10 and sends a command to the printing section, instructing printing of the information to be recorded (e.g., "A", "B", "C", "D" and "E"). Responsive to the command, the printing section 201 starts printing on the thermoreversible recording/display layer 13 via the transparent protective layer 14, the protective layer 17 or the substrate 21, using the thermal head 202 and under the conditions of printing power of 0.1 w/dot, and printing time of 1 msec.

(3) The portions of "A", "B", "C", "D" and "E" printed on the thermoreversible recording/display layer 13 by means of the thermal head 202 are heated to 120° to 200° C. (rather than 82° to 200° C. as in Embodiment 29), and cooled rapidly at a rate of 50° C./sec or more to room temperature, these portions are made transparent (state D in FIG. 2).

(4) After the printing, the user takes the thermoreversible recording medium 10 out of the recording device 200. Then, the thermoreversible recording medium 10 has the printed portions of "A", "B", "C", "D" and "E" fixed at the transparent state. Because of the contrast between the transparent state and the opaque state, the user can visually discern the recorded information "A", "B", "C", "D" and "E", and this information is retained until the recording medium is used next.

(5) When the user again inserts the thermoreversible recording medium 10 in the recording device 200, for erasing the previous information and recording a different information on the thermoreversible recording medium 10, the thermoreversible recording medium 10 is heated by the heating roller 203 in the printing section 201 to a temperature range of 80° to 200° C. and is then cooled slowly at a rate of 50° C./sec, or is heated to a temperature range of 80° to 120° C. and is then cooled without regard to cooling rate. The thermoreversible recording/display layer 13 then becomes opaaque (state A in FIG. 2), and the information previously recorded is erased.

A different information can be recorded through the steps (2) and (3) described above.

When a different information is not recorded, but the information previously recorded is just erased, the thermoreversible recording medium 10 is heated to a temperature range of 80° to 200° C. and is then cooled slowly at a rate of 50° C./sec, or is heated to a temperature range of 80° to 120° C. and is then cooled without regard to cooling rate. The thermoreversible recording/display layer 13 then becomes opaque (state A in FIG. 2), and is fixed at the opaque state. The user can obtain a thermoreversible recording medium 10 with the previously recorded information having been erased.

Embodiment 31

The procedure for use of the thermoreversible recording medium 10 made of a thermoreversible recording material according to Embodiment 1 and having transmittance characteristics illustrated in FIG. 1 in combination with the recording device 300 is as follows:

(1) First, the user inserts the thermoreversible recording medium 10 in the recording section 301 of the recording device 300.

(2) The recording device 300 senses the insertion of the thermoreversible recording medium 10 and reads, by means of the reading head 302, the encoded information from the recording layer 16 of the thermoreversible recording medium 10.

(3) As required, a new encoded information is recorded in the recording layer 16 by means of the recording head 303.

(4) The thermoreversible recording medium 10 is heated by the heating roller 213 in the printing section 211 to a temperature range of 82° to 200° C. and is then cooled slowly at a rate of 50° C./sec. The thermoreversible recording/display layer 13 then becomes opaque (state A in FIG. 1), and the information previously recorded is erased.

(5) The host computer sends a command to the printing section 211 for printing visual information (e.g., the balance, i.e., the remaining amount of money) corresponding to the encoded information.

(6) Responsive to the command, the printing section 211 starts printing on the thermoreversible recording/display layer 13 via the transparent protective layer 14, the protective layer 17 or the substrate 21, using the thermal head 212.

Embodiment 32

The procedure for use of the thermoreversible recording medium made of a thermoreversible recording material according to any of Embodiments 2 to 6 and having transmittance characteristics illustrated in FIG. 2 10 in combination with the recording device 300 is as follows:

(1) First, the user inserts the thermoreversible recording medium 10 in the recording section 301 of the recording device 300.

(2) The recording device 300 senses the insertion of the thermoreversible recording medium 10 and reads, by means of the reading head 302, the encoded information from the recording layer 16 of the thermoreversible recording medium 10.

(3) As required, a new encoded information is recorded in the recording layer 16 by means of the recording head 303.

(4) The thermoreversible recording medium 10 is heated by the heating roller 213 in the printing section 211 to a temperature range of 80° to 200° C. and is then cooled slowly (at a rate of 50° C./sec), or is heated to a temperature range of 80° to 120° C. and is then cooled without regard to cooling rate. The thermoreversible recording/display layer 13 then becomes opaque (state A in FIG. 2), and the information previously recorded is erased.

(5) The host computer sends a command to the printing section 211 for printing visual information (e.g., the balance) corresponding to the new encoded information.

(6) Responsive to the command, the printing section 211 starts printing on the thermoreversible recording/display layer 13 via the transparent protective layer 14, the protective layer 17 or the substrate 21, using the thermal head 212.

Modifications

Various embodiments of the invention have been described in detail, but the materials and numerical conditions used in the embodiments are only example, and the invention is not limited to these materials and conditions.

For instance, in any of the embodiments described above, the upper surface of the thermoreversible recording/display layer may be bonded to a layer over it via an adhesive layer, and the lower surface of the thermoreversible recording/display layer may also be bonded to a layer beneath it via another adhesive layer, and a printed layer may further be provided over and adjacent to, or beneath and adjacent to the adhesive layer.

Description on the printing of characters and graphics was made in connection with only some of the embodiments. But, the printing of the characters and graphics can also made on the thermoreversible recording media of other embodiments.

Description on the handwriting on the transparent protective layer and the transparent substrate was made in connection with only some of the embodiments. But, handwriting can also be made on the thermoreversible recording/display layer of other embodiments. To repeat handwriting and erasure with the solvent, the layer on which the handwriting is made must be sufficiently thick. From this viewpoint, the arrangement where the handwriting is made on the transparent substrate which is relatively thick is advantageous.

The terms "over" and "beneath" were used in the description of various embodiment for describing the relative position between layers. This however is by way of convenience and for easier understanding with regard to the illustration in the drawings. This should not be construed that the thermoreversible recording medium is used only in the illustrated attitude. Where the visual information displayed by the thermoreversible recording/display layer is directly seen by the user, the upper side is the side from which the medium is seen.

Advantages

As has been described in detail above, the invention provides a thermoreversible recording material which, when heated and then cooled, is fixed at a transparent state or an opaque state depending on the rate of the cooling and the temperature to which the thermoreversible recording material is heated, and a thermoreversible recording medium and a recording method, so the following advantages are expected.

(1) By the provision of the novel thermoreversible recording materials, the range of temperature with which the thermoreversible recording material can be made transparent and opaque can be made wider than with the conventional thermoreversible recording material, and the contrast also is improved.

(2) Since it is possible to repeatedly record and erase information, the thermoreversible recording medium can be re-used, and it is therefore possible to save natural resources.

(3) The printing can be accomplished by a simple heating means such as a thermal head, so that the thermal heads or the like that have been used with the conventional thermosensitive paper can also be used.

(4) It is necessary to heat the thermoreversible recording/display layer above a considerably high temperature (e.g., 82° C. or 80° C.) in order to erase the information, so erasure does not take place at room temperature. Accordingly, the recorded data is well preserved.

(5) Visual information with a good contrast can be recorded.

(6) The thermoreversible recording medium can be made in the form of a card, in which case the portability is improved.

(7) The thermoreversible recording medium according to the invention may be additionally provided with a layer for recording encoded information, so encoded information can be recorded in addition to the visual information.

(8) The thermoreversible recording medium according to the invention may permits printing of characters and graphics at the peripheral portion of the transparent protective layer or the transparent substrate, so information which need not be altered or erased can be displayed.

What is claimed is:

1. A thermoreversible recording material comprising a matrix material and an organic compound of low molecular weight, the transparency of which is changed in accordance with its thermal history, characterized in that the matrix material is polyvinyl acetal and the organic compound of low molecular weight is at least one selected from the group consisting of a saturated carboxylic acid, an amide-, an amine-, an anilide-, an alcohol-, an ester-, a ketone-, a metal salt-, and an imidazole of the saturated carboxylic acid.

2. A thermoreversible recording material according to claim 1, wherein the saturated carboxylic acid has 10 to 40 carbon atoms.

3. A thermoreversible recording material according to claim 1, wherein two or more of the organic compounds are used together in admixture.

4. A thermoreversible recording material according to claim 1, wherein the blending ratio in weight of the organic compound to the matrix material is within 1:2 to 20:1.

5. A thermoreversible recording material according to claim 1, wherein said matrix material further contains a material selected from a group consisting of epoxy resin, phenol resin, an epoxy compound, an aldehyde compound, and an isocyanate compound.

6. A thermoreversible recording material according to claim 5, wherein the blending ratio of polyvinylacetal and said material selected from said group is in the range 1:20–20:1.

7. A thermoreversible recording material according to claim 5, wherein said material selected from said group is an epoxy compound, and said epoxy compound has a functional group represented by one of the following general formulae:

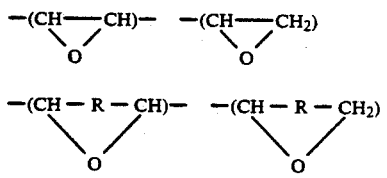

where R represents a divalent hydrocarbon group.

8. A thermoreversible recording material according to claim 7, wherein said epoxy compound is a monoepoxy compound, a diepoxy compound, or a polyepoxy compound.

9. A thermoreversible recording material according to claim 5, wherein said material selected from said group is an aldehyde compound, and said aldehyde compound has a functional group represented by the following general formula:

CHO—

10. A thermoreversible recording material according to claim 9, wherein said aldehyde compound is a monoaldehyde compound, a dialdehyde compound, or a polyaldehyde compound.

11. A thermoreversible recording material according to claim 5, wherein said material selected from said group is an isocyanate compound, and said isocyanate compound has a functional group represented by the general formula:

—NCO.

12. A thermoreversible recording material according to claim 11, wherein said isocyanate compound is a monoisocyanate compound or a diisocyanate compound.

13. A thermoreversible recording medium comprising:

(1) a substrate; and (2) a thermoreversible recording/display layer that is superposed with said substrate layer and is made of a thermoreversible recording material whose transmittance varies with its thermal history;

said thermoreversible recording material comprising a matrix material of polyvinyl acetal and at least one selected from the group consisting of a saturated carboxylic acid, an amide-, an amine-, an anilide-, an alcohol-, an ester-, a ketone-, a metal salt- and an imidazole of the saturated carboxylic acid.

14. A thermoreversible recording medium according to claim 13, wherein said substrate is made of a material selected from among plastic and synthetic paper.

15. A thermoreversible recording medium according to claim 13, further comprising:

(3) a reflecting/absorbing layer superposed with said thermoreversible recording/display layer and said substrate.

16. A thermoreversible recording medium according to claim 15, wherein said substrate, said reflecting/absorbing layer and said thermoreversible recording/display layer are stacked in the stated order.

17. A thermoreversible recording medium according to claim 16, further comprising:

(4) an enhancing layer that is formed between said thermoreversible recording/display layer and said reflecting/absorbing layer.

18. A thermoreversible recording medium according to claim 13, wherein said reflecting/absorbing layer is a colored layer that is printed with a color presenting a strong contrast with white.

19. A thermoreversible recording medium according to claim 13, wherein said reflecting/absorbing layer is a colored layer that is printed in a plurality of colors presenting a strong contrast with white.

20. A thermoreversible recording medium according to claim 13, wherein said reflecting/absorbing layer is printed with a coating material containing a fluorescent coating material.

21. A thermoreversible recording medium according to claim 13, wherein said reflecting/absorbing layer is printed with a coating material containing carbon black or metallic powder having good thermal conductivity.

22. A thermoreversible recording medium according to claim 13, further comprising:

a transparent protective layer that is formed to cover said thermoreversible recording/display layer.

23. A thermoreversible recording medium according to claim 22, wherein characters and graphics are printed on said transparent protective layer.

24. A thermoreversible recording medium according to claim 13, further comprising:

an enhancing layer that is formed between said thermoreversible recording/display layer and said reflecting/absorbing layer, and has an index of refraction sufficiently different from the index of refraction of said thermoreversible recording/display layer, thereby serving to heighten contrast between portions exhibiting higher transmittance and portions exhibiting lower transmittance.

25. A thermoreversible recording medium according to claim 13, wherein said substrate also serves as said reflecting/absorbing layer.

26. A thermoreversible recording medium according to claim 25, wherein said substrate is made of a material selected from among inorganic fibrous paper of good thermal conductivity, ceramic sheet, metallic sheet, and plastic sheet in which is dispersed carbon black, metal powder or the like.

27. A thermoreversible recording medium according to claim 25, further comprising:

(3) an enhancing layer that is formed between said thermoreversible recording/display layer and said reflecting/absorbing layer, and serves to heighten the contrast between transparent and opaque portions.

28. A thermoreversible recording medium according to claim 13, further comprising:

(3) a recording layer that is superposed with said substrate and records encoded information.

29. A thermoreversible recording medium according to claim 28, wherein said thermoreversible recording-/display layer and said recording layer being provided on opposite sides of said substrate.

30. A thermoreversible recording medium according to claim 29, further comprising:

a protective layer that is formed to cover said recording layer.

31. A thermoreversible recording medium according to claim 29, wherein said recording layer is formed to extends over only part of an area over which said thermoreversible recording/display layer extends.

32. A thermoreversible recording medium according to claim 13, wherein said substrate is transparent.

33. A thermoreversible recording medium according to claim 32, wherein said substrate is made of transparent plastic.

34. A thermoreversible recording medium according to claim 32, further comprising:

(3) a reflecting/absorbing layer that is superposed with said transparent substrate.

35. A thermoreversible recording medium according to claim 34, wherein said reflecting/absorbing layer, said substrate, and said thermoreversible recording/display layer and are stacked in the stated order.

36. A thermoreversible recording medium according to claim 35, further comprising:

(4) an adhesive layer formed between peripheral portions of said substrate and said reflecting/absorbing layer, to form a space by which central portions of said substrate and said reflecting/absorbing layer are separated from each other;

wherein said space formed between the central portions of said substrate and said reflecting/absorbing layer serves as an enhancing layer to heighten the contrast between the portions of the thermoreversible recording/display layer exhibiting higher and lower transmittances.

37. A thermoreversible recording medium according to claim 34, wherein said reflecting/absorbing layer, said thermoreversible recording/display layer, and said substrate are stacked in the stated order.

38. A thermoreversible recording medium according to claim 37, further comprising:

(4) a protective layer that is formed to cover said reflecting/absorbing layer.

39. A thermoreversible recording medium according to claim 37, further comprising:

(4) an enhancing layer that is formed between said thermoreversible recording/display layer and said reflecting/absorbing layer.

40. A thermoreversible recording medium according to claim 37, further comprising:

(4) a recording layer that is superposed with said reflecting/absorbing layer and records encoded information.

41. A thermoreversible recording medium according to claim 40, wherein said recording layer is provided on one side of said reflecting/absorbing layer opposite to the other side on which said thermoreversible recording/display layer is provided.

42. A thermoreversible recording medium according to claim 41, further comprising:

(5) a protective layer that is formed to cover said recording layer.

43. A thermoreversible recording medium according to claim 32, further comprising:

(3) a transparent protective layer that is formed to cover said thermoreversible recording/display layer.

44. A thermoreversible recording medium according to claim 32, wherein wherein characters or graphics are printed on said transparent substrate.

45. A thermoreversible recording medium according to claim 13, wherein said substrate comprises a planar light source of the edge-lighted type.

46. A thermoreversible recording medium according to claim 45, wherein characters or graphics are printed on said planar light source.

47. A recording method comprising the steps of:

(1) heating a thermoreversible recording material of polyvinyl acetal and at least one selected from the group consisting of a saturated carboxylic acid, an amide-, an amine-, an anilide-, an alcohol-, an ester-, a ketone-, a metal salt- and an imidazole of the saturated carboxylic acid, and then (2) cooling the thermoreversible recording material at a controlled rate to control the transmittance of the thermoreversible recording material after the cooling.

48. A recording method comprising the steps of:

(1) heating a specific portion of a thermoreversible recording medium having a thermoreversible recording/display layer comprising a matrix material of polyvinyl acetal and at least one selected from the group consisting of a saturated carboxylic acid, an amide-, an amine-, an anilide-, an alcohol-, an ester-, a ketone-, a metal salt- and an imidazole of the saturated carboxylic acid; and then (2) cooling the thermoreversible recording medium at a controlled rate to control the transmittance of the specific portion of said thermoreversible recording medium.

49. A thermoreversible recording medium according to claim 18, wherein said color presenting a strong contrast with white is selected from the group consisting of black, red and blue.

* * * * *